US009475317B2

(12) United States Patent
Samoto

(10) Patent No.: US 9,475,317 B2
(45) Date of Patent: Oct. 25, 2016

(54) POWER TRANSMISSION SWITCHING DEVICE AND LIQUID EJECTION APPARATUS

(71) Applicant: BROTHER KOGYO KABUSHIKI KAISHA, Nagoya-shi, Aichi-ken (JP)

(72) Inventor: Kenji Samoto, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/671,431

(22) Filed: Mar. 27, 2015

(65) Prior Publication Data

US 2015/0273906 A1 Oct. 1, 2015

(30) Foreign Application Priority Data

Mar. 31, 2014 (JP) ..... 2014-072729

(51) Int. Cl.

*B41J 23/02* (2006.01)
*B41J 2/165* (2006.01)
*B41J 13/00* (2006.01)

(52) U.S. Cl.

CPC ..... *B41J 23/025* (2013.01); *B41J 2/16511* (2013.01); *B41J 13/0009* (2013.01); *Y10T 74/19074* (2015.01)

(58) Field of Classification Search

CPC ..... B41J 11/007; B41J 11/06; B41J 11/0085; B41J 13/103; B41J 11/0065; B41J 23/025; B41J 13/0009; B41J 2/16511; Y10T 74/19074

USPC ..... 347/104, 101

See application file for complete search history.

(56) References Cited

U.S. PATENT DOCUMENTS

2007/0059043 A1* 3/2007 Tanaka ..... G03G 15/0126 399/227
2008/0157460 A1* 7/2008 Izuchi ..... B65H 3/0669 271/109
2009/0035018 A1 2/2009 Koga et al.
2009/0035019 A1 2/2009 Koga et al.
2012/0287202 A1* 11/2012 Suzuki ..... B41J 2/16532 347/30

FOREIGN PATENT DOCUMENTS

JP 62-5141 U 1/1987
JP 2008-238456 A 10/2008
JP 2009-034832 A 2/2009
JP 2013-071407 A 4/2013

* cited by examiner

*Primary Examiner* — Manish S Shah
*Assistant Examiner* — Yaovi M Ameh
(74) *Attorney, Agent, or Firm* — Merchant & Gould P.C.

(57) ABSTRACT

A power transmission switching device includes a transmission mechanism. The transmission mechanism includes: a first gear; a second gear; a switching gear movable between a first position for mesh with the first gear and a second position for mesh with the second gear; an input gear meshed with the switching gear; and a power transmitter comprising the input gear and configured to transmit the driving power from the drive source to the switching gear. Play is formed in the power transmitter so as to allow the input gear to rotate in its rotational direction.

11 Claims, 12 Drawing Sheets

81b
81a
81
T
71
71b
71a
82a
82
82b
ROTATIONAL DIRECTION
LEFT
RIGHT
9

POWER TRANSMISSION SWITCHING DEVICE AND LIQUID EJECTION APPARATUS

CROSS REFERENCE TO RELATED APPLICATION

The present application claims priority from Japanese Patent Application No. 2014-072729, which was filed on Mar. 31, 2014, the disclosure of which is herein incorporated by reference in its entirety.

BACKGROUND

1. Technical Field

The following disclosure relates to a power transmission switching device and a liquid ejection apparatus.

2. Description of the Related Art

There is conventionally known an image recording apparatus configured to perform a rocking operation for mesh of gears, when an image recording instruction is received in a standby state in which a recording head is capped by a cap. This rocking operation is for meshing a switching gear with a first or a second receiving gear. In this rocking operation, an ASF motor is controlled to cause forward rotations and reverse rotations of the switching gear a predetermined number of times, whereby the switching gear is meshed with a desired one of the receiving gears, allowing power transmission. Also, power can be transmitted by meshing the switching gear selectively to one of the plurality of receiving gears, eliminating a need to provide a plurality of drive sources.

SUMMARY

In the above-described image recording apparatus, however, the rocking operation requires a considerably long time because the switching gear is rotated forwardly and reversely the predetermined number of times in order to mesh the switching gear with the first or second receiving gear. As a result, a longer time is required from the reception of the image recording instruction in the standby state to discharging of an image-recorded recording medium.

Accordingly, an aspect of the disclosure relates to a power transmission switching device and a liquid ejection apparatus which require a relatively short time for changing a gear meshed with a switching gear from a second output gear to a first output gear.

In one aspect of the disclosure, a power transmission switching device includes: a drive source; a first driven mechanism; a second driven mechanism; and a transmission mechanism configured to transmit driving power transmitted from the drive source, selectively to one of the first driven mechanism and the second driven mechanism. The transmission mechanism includes: an input gear rotatable by the driving power transmitted from the drive source; a first gear configured to transmit the driving power to the first driven mechanism; a second gear configured to transmit the driving power to the second driven mechanism; a switching gear movable, in a direction parallel with an axial direction of the input gear, between a first position at which the switching gear is meshed with the first gear and a second position at which the switching gear is meshed with the second gear, the switching gear being meshed with the input gear when the switching gear is located at any of the first position and the second position; and a power transmitter comprising the input gear and configured to transmit the driving power from the drive source to the switching gear. Play is formed in the power transmitter to allow the input gear to rotate in a rotational direction thereof.

In another aspect of the disclosure, a liquid ejection apparatus includes: a liquid ejection head comprising an ejection surface from which the liquid ejection head ejects liquid; a conveyor configured to convey a recording medium in a conveying direction such that the recording medium is to face the ejection surface; and the power transmission switching device.

In another aspect of the disclosure, a liquid ejection apparatus includes: a liquid ejection head having an ejection surface from which the liquid ejection head ejects liquid; a moving mechanism configured to reciprocate the liquid ejection head in a direction perpendicular to a direction in which a recording medium is conveyed; a first driven mechanism; a second driven mechanism; a first drive source; a second drive source; a first transmission mechanism configured to transmit driving power transmitted from the first drive source, to the moving mechanism; and a second transmission mechanism configured to transmit driving power transmitted from the second drive source, selectively to one of the first driven mechanism and the second driven mechanism. The second transmission mechanism includes: a first shaft member rotatable by the driving power transmitted from the second drive source; a first gear configured to transmit driving power to the first driven mechanism; a second gear configured to transmit driving power to the second driven mechanism; a second shaft member parallel with a central axis of the first shaft member; a switching gear movable, in a direction parallel with an axial direction of the shaft member, between a first position at which the switching gear is meshed with the first gear and a second position at which the switching gear is meshed with the second gear; an input gear supported by the first shaft member so as to be rotated with the first shaft member, the input gear being meshed with the switching gear when the switching gear is located at any of the first position and the second position; a switcher configured to move the switching gear from the first position to the second position with movement of the liquid ejection head to a particular position by the moving mechanism; and an urging mechanism configured to urge the switching gear from the second position toward the first position. The input gear and the first shaft member are configured such that the input gear has play with respect to the first shaft member in a rotational direction of the first shaft member.

In another aspect of the disclosure, a power transmission switching device includes: a drive source; a first driven mechanism; a second driven mechanism; and a transmission mechanism configured to transmit driving power transmitted from the drive source, selectively to one of the first driven mechanism and the second driven mechanism. The transmission mechanism includes: a shaft member rotatable by the driving power transmitted from the drive source; a first transmission mechanism including a plurality of gears including a first gear configured to transmit the driving power to the first driven mechanism; a second transmission mechanism including a plurality of gears including a second gear configured to transmit the driving power to the second driven mechanism; a switching gear movable, in a direction parallel with an axial direction of the shaft member, between a first position at which the switching gear is meshed with the first gear and a second position at which the switching gear is meshed with the second gear; a switcher configured to move the switching gear selectively to one of the first position and the second position; and an input gear supported by the shaft member so as to be rotated with the shaft member, the input gear being meshed with the switching gear when the switching gear is located at any of the first position and the second position. The plurality of gears of the first transmission mechanism include: a sun gear; a planetary gear meshed with the sun gear and movable along a rotational direction of the sun gear; and an intermediate gear meshed with the planetary gear and rotated when the sun gear is rotated by rotation of the first gear in a first rotational direction, the intermediate gear not being meshed with the planetary gear when the sun gear is rotated by rotation of the first gear in a second rotational direction reverse to the first rotational direction.

In another aspect of the disclosure, a liquid ejection apparatus includes: the power transmission switching device; a liquid ejection head having an ejection surface from which the liquid ejection head ejects liquid; and a moving mechanism configured to reciprocate the liquid ejection head in a direction perpendicular to a direction in which a recording medium is conveyed. The power transmission switching device further includes: a first drive source; a second drive source as the drive source; a first transmission mechanism configured to transmit driving power transmitted from the first drive source, to the moving mechanism; and a second transmission mechanism, as the transmission mechanism, configured to transmit driving power transmitted from the second drive source, selectively to one of the first driven mechanism and the second driven mechanism. The second transmission mechanism includes: a first shaft member, as the shaft member, rotatable by the driving power transmitted from the second drive source; a second shaft member parallel with a central axis of the first shaft member; and an urging mechanism configured to urge the switching gear from the second position toward the first position. The switcher is configured to move the switching gear from the first position to the second position with movement of the liquid ejection head to a particular position by the moving mechanism. The first gear serves as the sun gear. The first driven mechanism includes a third gear as the intermediate gear. The second transmission mechanism further includes a fourth gear, as the planetary gear, meshable with the first gear. The fourth gear is configured to be positioned selectively at one of a third position at which the fourth gear transmits driving power transmitted from the first gear, to the third gear and a fourth position at which the fourth gear is rotatable with the first gear and does not transmit driving power transmitted from the first gear, to the third gear. The fourth gear is configured to move to the third position by being moved along a first rotational direction by rotation of the first gear in the first rotational direction. The fourth gear is configured to move to the fourth position by being moved along a second rotational direction reverse to the first rotational direction by rotation of the first gear in the second rotational direction.

In another aspect of the disclosure, a liquid ejection apparatus includes: the power transmission switching device; a liquid ejection head having an ejection surface from which the liquid ejection head ejects liquid; and a moving mechanism configured to reciprocate the liquid ejection head in a direction perpendicular to a direction in which a recording medium is conveyed. The power transmission switching device further includes: a first drive source; a second drive source as the drive source; a first transmission mechanism configured to transmit driving power transmitted from the first drive source, to the moving mechanism; and a second transmission mechanism, as the transmission mechanism, configured to transmit driving power transmitted from the second drive source, selectively to one of the first driven mechanism and the second driven mechanism. The second transmission mechanism includes: a first shaft member, as the shaft member, rotatable by the driving power transmitted from the second drive source; a second shaft member parallel with a central axis of the first shaft member; and an urging mechanism configured to urge the switching gear from the second position toward the first position. The switcher is configured to move the switching gear from the first position to the second position with movement of the liquid ejection head to a particular position by the moving mechanism. The first driven mechanism includes a third gear. The second transmission mechanism further includes: a fourth gear, as the sun gear, configured to be rotated by driving power transmitted from the first gear; and a fifth gear, as the planetary gear, meshable with the fourth gear. The fifth gear is configured to be positioned selectively at one of a third position at which the fifth gear transmits driving power transmitted from the first gear, to the third gear and a fourth position at which the fifth gear is rotatable with the first gear and does not transmit driving power transmitted from the first gear, to the third gear. The fifth gear is configured to move to the third position by being moved along a first rotational direction by rotation of the fourth gear in the first rotational direction. The fifth gear is configured to move to the fourth position by being moved along a second rotational direction reverse to the first rotational direction by rotation of the fourth gear in the second rotational direction.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which:

FIGS. 5A and 5B are views illustrating a maintenance mechanism illustrated in FIG. 4, wherein FIG. 5A illustrates a separated state in which a cap is spaced apart from an ejection surface, and FIG. 5B illustrates a contact state in which the cap is held in contact with the ejection surface;

FIGS. 7A and 7B are side views of a transmission mechanism of the printing unit which is viewed from a front side, wherein FIG. 7A illustrates a situation in which a switching gear is located at a first position, and FIG. 7B illustrates a situation in which the switching gear is located at a second position;

FIGS. 9A through 9D are views each illustrating a situation of the transmission mechanism illustrated in FIGS. 7A and 7B, wherein FIG. 9A illustrates a situation when a sheet is conveyed, FIG. 9B illustrates a situation when an ejection surface of a recording head is changed to a sealing state, FIG. 9C illustrates a situation when the ejection surface of the recording head is changed to a non-sealing state, and FIG. 9D illustrates a situation when a contact portion of a shaft member is moved to a generally center between a pair of faces of the input gear;

FIGS. 10A through 10C are views illustrating a situation when the switching gear is moved from the second position to the first position, wherein FIG. 10A is a cross-sectional view taken along line XA-XA in FIG. 7, FIG. 10B is a cross-sectional view illustrating a situation in which the switching gear is being moved from the second position to the first position, and FIG. 10C is a cross-sectional view taken along line XC-XC in FIG. 7;

FIGS. 11A and 11B are views each illustrating a situation of a transmission mechanism in a first modification of the one embodiment, wherein FIG. 11A illustrates a situation when a planetary gear is located at a power transmitting position, and FIG. 11B illustrates a situation when the planetary gear is located at a separated position; and FIGS. 12A and 12B are views each illustrating a situation of a transmission mechanism in a second modification of the one embodiment, wherein FIG. 12A illustrates a situation when a planetary gear is located at a power transmitting position, and FIG. 12B illustrates a situation when the planetary gear is located at a separated position.

DETAILED DESCRIPTION OF THE EMBODIMENTS

Figure 1:
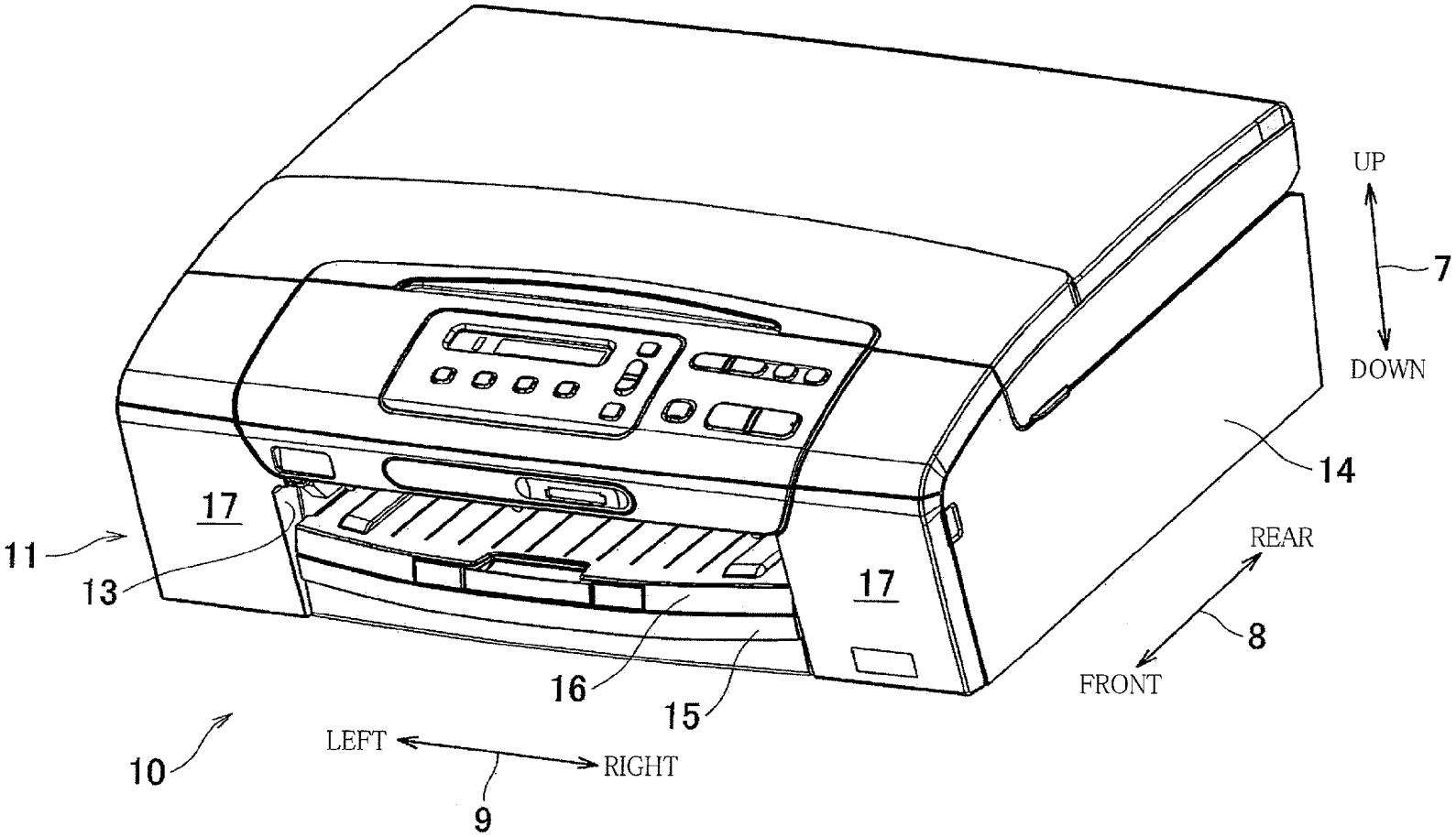
FIG. 1 is a perspective view illustrating a multi-function peripheral (MFP) in one embodiment.

Hereinafter, there will be described a multi-function peripheral (MFP) 10 including a printing unit according to one embodiment. The MFP 10 is used in a state illustrated in FIG. 1. In the present embodiment, three directions indicated by the arrows in FIG. 1 are an up and down direction 7, a front and rear direction 8, and a right and left direction 9. These directions are used also in other figures.

Configuration of MFP 10

As illustrated in FIG. 1, the MFP 10 has a generally rectangular parallelepiped shape so as to have a low profile. A printing unit 11 as one example of a liquid ejection apparatus is provided in a lower portion of the MFP 10. The MFP 10 has various kinds of functions such as a facsimile function and a printing function.

The printing unit 11 is covered with a housing 14. A front wall 17 is disposed on the front side of the housing 14 so as to extend in the up and down direction 7 and in the right and left direction 9. An opening 13 is formed in a generally central portion of the front wall 17. A sheet-supply tray 15 and a sheet-output tray 16 can be inserted and removed into and from the printing unit 11 through the opening 13 in the front and rear direction. Sheets P of a desired size can be placed on the sheet-supply tray 15.

The MFP 10 can be connected to an external device such as a personal computer (PC). The MFP 10 performs various kinds of functions based on instructions transmitted from the PC.

Internal Structure of Printing Unit 11

Figure 2:
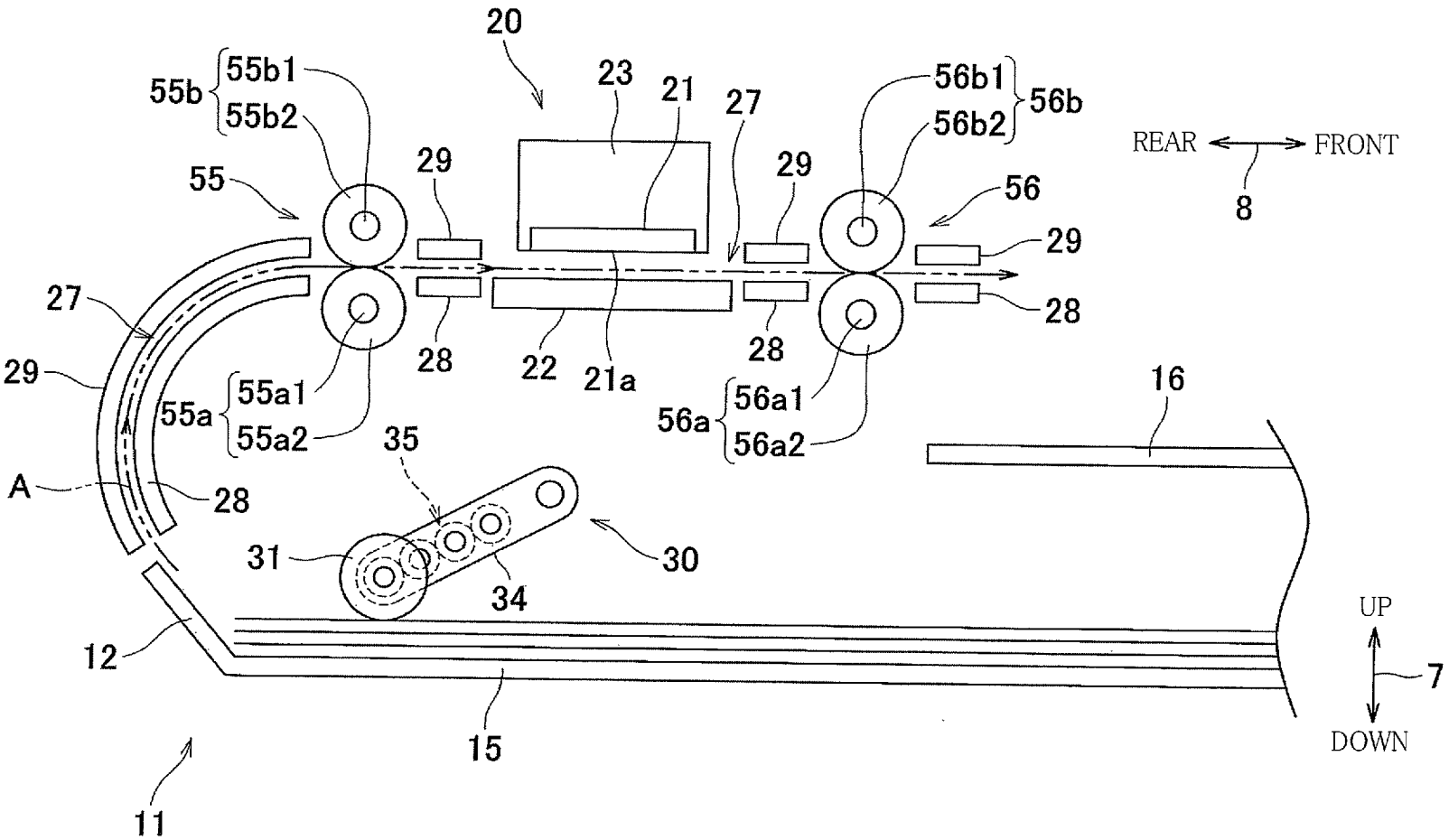
FIG. 2 is a schematic side view illustrating an internal structure of a printing unit illustrated in FIG. 1.

There will be next explained an internal structure of the printing unit 11. As illustrated in FIG. 2, the printing unit 11 includes a supply device 30, a conveying roller pair 55 as one example of a conveyor, a recording device 20, a sheet-discharge roller pair 56, a carriage drive motor 201 (see FIG. 6) as one example of a first drive source, a drive motor 202 (see FIG. 6) as one example of a drive source and a second drive source, a shaft member 38*a* (see FIG. 4), a transmission mechanism 70 (see FIGS. 7A and 7B), and a controller 5 (see FIG. 6). The supply device 30 supplies a sheet P placed on the sheet-supply tray 15, into a conveyance path 27. The conveying roller pair 55 conveys the sheet P supplied from the supply device 30, to the recording device 20. The recording device 20 is an ink-jet recording device, for example, and records an image on the sheet P conveyed by the conveying roller pair 55. The sheet-discharge roller pair 56 discharges the sheet P on which an image has been recorded by the recording device 20, onto the sheet-output tray 16.

Supply Device 30

As illustrated in FIG. 2, the supply device 30 is provided on an upper side of the sheet-supply tray 15. The supply device 30 includes a sheet-supply roller 31, a sheet-supply arm 34, and a gear train 35. The sheet-supply roller 31 is supported by a shaft at an end portion of the sheet-supply arm 34. The sheet-supply arm 34 is pivotably mounted on a frame of the printing unit 11, not shown, allowing the sheet-supply roller 31 to be moved upward and downward with respect to the sheet-supply tray 15. The gear train 35 is constituted by a plurality of gears arranged in the sheet-supply arm 34. When driving power generated by forward rotation of the drive motor 202 is transmitted to the gear train 35 via the transmission mechanism 70, a gear 59 (which will be described below), and a transmission mechanism, not shown, the sheet-supply roller 31 is rotated in a clockwise direction in FIG. 2. The sheet-supply roller 31 is rotated in a state in which the sheet-supply roller 31 is held in a pressing contact with an uppermost one of the sheet P placed on the sheet-supply tray 15. This rotation of the sheet-supply roller 31 supplies the uppermost sheet P into the conveyance path 27.

Sheet-Supply Tray 15

As illustrated in FIG. 2, the sheet-supply tray 15 has an oblique wall portion 12. When the sheet P placed on the sheet-supply tray 15 is supplied by the sheet-supply roller 31, the oblique wall portion 12 guides the sheet P into the conveyance path 27.

Conveyance Path 27

As illustrated in FIG. 2, the conveyance path 27 extends from a rear end portion of the sheet-supply tray 15 while curving upward and frontward and then extends frontward from a rear side of the printing unit 11. The conveyance path 27 further extends through a sheet nipping position of the conveying roller pair 55, a position under the recording device 20, and a sheet nipping position of the sheet-discharge roller pair 56 and reaches the sheet-output tray 16. The sheet P supplied from the sheet-supply tray 15 is conveyed along the conveyance path 27 so as to make upward U-turn and reaches the position under the recording device 20. After an image is recorded on the sheet P by the recording device 20, the recorded sheet P is discharged onto the sheet-output tray 16. The conveyance path 27 is defined by an outer guide member 29 and an inner guide member 28, except a portion thereof where the recording device 20 and so on are disposed. The outer guide member 29 and the inner guide member 28 are opposed to each other at a predetermined distance.

Conveying Roller Pair 55 and Sheet-Discharge Roller Pair 56

A direction in which the sheet P is conveyed along the conveyance path 27 (i.e., a direction indicated by the two-dot-chain-line arrow in FIG. 2) will be hereinafter referred to as "sheet conveying direction A". As illustrated in FIG. 2, the conveying roller pair 55 is provided upstream of the recording device 20 in the sheet conveying direction A. The conveying roller pair 55 is constituted by: a conveying roller 55*a* disposed on a lower side of the conveyance path 27; and a pinch roller 55*b* disposed on an upper side of the conveyance path 27. The conveying roller 55*a* is constituted by a shaft member 55*a*1 extending in the right and left direction 9 and a roller 55*a*2 fitted on the shaft member 55*a*1 and rotated integrally with the shaft member 55*a*1. The pinch roller 55*b* is constituted by a shaft member 55*b*1 extending in the right and left direction 9 and a roller 55*b*2 fitted on the shaft member 55*b*1 and rotated integrally with the shaft member 55*b*1. The pinch roller 55*b* is rotated by rotation of the conveying roller 55*a*. The conveying roller 55*a* and the pinch roller 55*b* cooperate to nip the sheet P in the up and down direction 7 to convey the sheet P in the sheet conveying direction A. It is noted that the conveying roller 55*a* may be provided above the pinch roller 55*b*.

The sheet-discharge roller pair 56 is provided downstream of the recording device 20 in the sheet conveying direction A. The sheet-discharge roller pair 56 is constituted by: a sheet-discharge roller 56*a* disposed on a lower side of the conveyance path 27; and a spur roller 56*b* disposed on an upper side of the conveyance path 27. The sheet-discharge roller 56*a* is constituted by a shaft member 56*a*1 extending in the right and left direction 9 and a roller 56*a*2 fitted on the shaft member 56*a*1 and rotated integrally with the shaft member 56*a*1. The spur roller 56*b* is constituted by a shaft member 56*b*1 extending in the right and left direction 9 and a spur 56*b*2 fitted on the shaft member 56*b*1 and rotated integrally with the shaft member 56*b*1. The spur roller 56*b* is rotated by rotation of the sheet-discharge roller 56*a*. The sheet-discharge roller 56*a* and the spur roller 56*b* cooperate to nip the sheet P in the up and down direction 7 to convey the sheet P in the sheet conveying direction A. The sheet-output tray 16 is disposed downstream of the sheet-discharge roller pair 56 in the sheet conveying direction A. The sheet-output tray 16 is provided downstream of the recording device 20 in the sheet conveying direction A.

Figure 3:
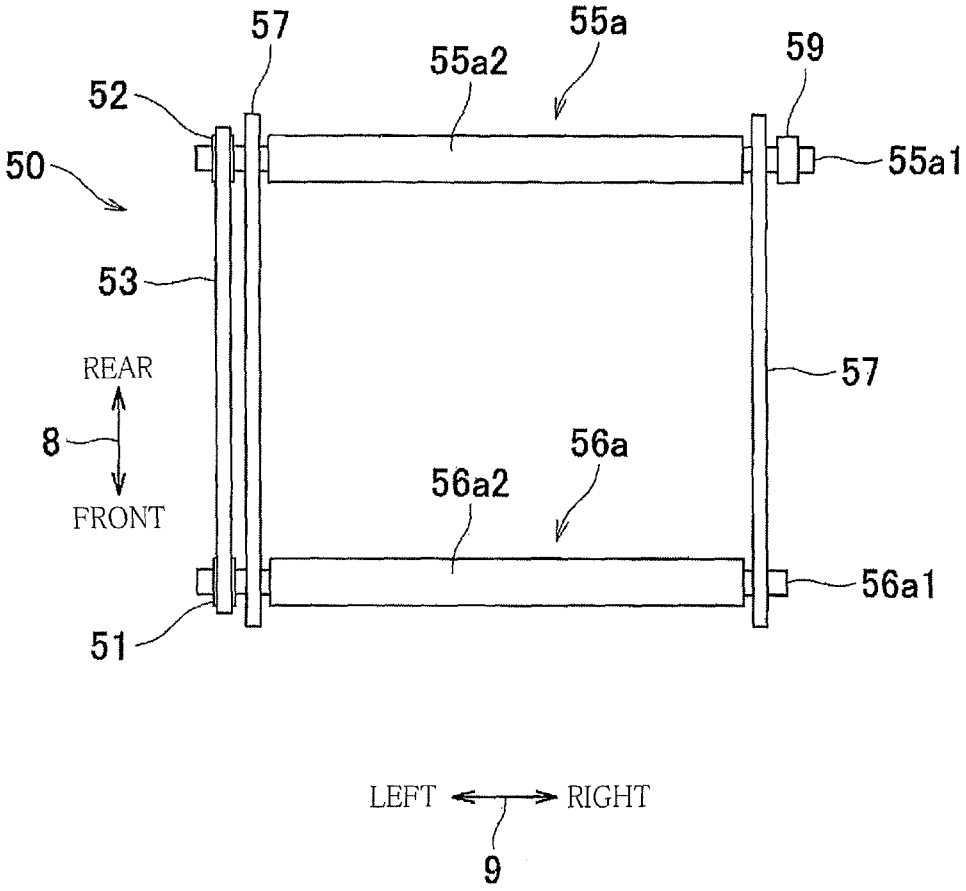
FIG. 3 is a plan view illustrating a conveying roller, a sheet-discharge roller, and a belt transmission mechanism.

Each of the shaft members 55*a*1, 55*b*1, 56*a*1, 56*b*1 of a corresponding one of the rollers of the conveying roller pair 55 and the sheet-discharge roller pair 56 is rotatably supported by a pair of frames 57 illustrated in FIG. 3. While FIG. 3 illustrates a situation in which the conveying roller 55*a* and the sheet-discharge roller 56*a* are supported by the pair of frames 57, the pinch roller 55*b* and the spur roller 56*b* are similarly supported by the pair of frames 57. The pair of frames 57 are spaced apart from each other in the right and left direction. The gear 59 is provided on a right end portion of the shaft member 55*a*1, and this gear 59 is fitted on the shaft member 55*a*1 and rotated integrally with the shaft member 55*a*1. The gear 59 is meshed with a first output gear 81 (as one example of a first gear) which will be described below (see FIG. 9A). The gear 59 transmits driving power to the transmission mechanism, not shown, for transmitting the driving power to the gear train 35. A belt transmission mechanism 50 is provided on left end portions of the respective shaft members 55*a*1, 56*a*1. The belt transmission mechanism 50 includes two pulleys 51, 52 and a timing belt 53. The pulley 51 is fitted on the left end portion of the shaft member 56*a*1 and rotated integrally with the shaft member 56*a*1. The pulley 52 is fitted on the left end portion of the shaft member 55*a*1 and rotated integrally with the shaft member 55*a*1. The timing belt 53 is an endless belt looped over these pulleys 51, 52. When the driving power generated by forward rotation of the drive motor 202 is transmitted to the gear 59 via the transmission mechanism 70, the conveying roller 55*a* and the sheet-discharge roller 56*a* are rotated in the clockwise direction in FIG. 2. As a result, the sheet P supplied from the sheet-supply tray 15 is conveyed in the sheet conveying direction A by the conveying roller pair 55 and the sheet-discharge roller pair 56. In view of the above, the supply device 30, the conveying roller pair 55, the sheet-discharge roller pair 56, and the belt transmission mechanism 50 are one example of a first driven mechanism which is a conveying mechanism configured to convey the sheet P.

Recording Device 20

Figure 4:
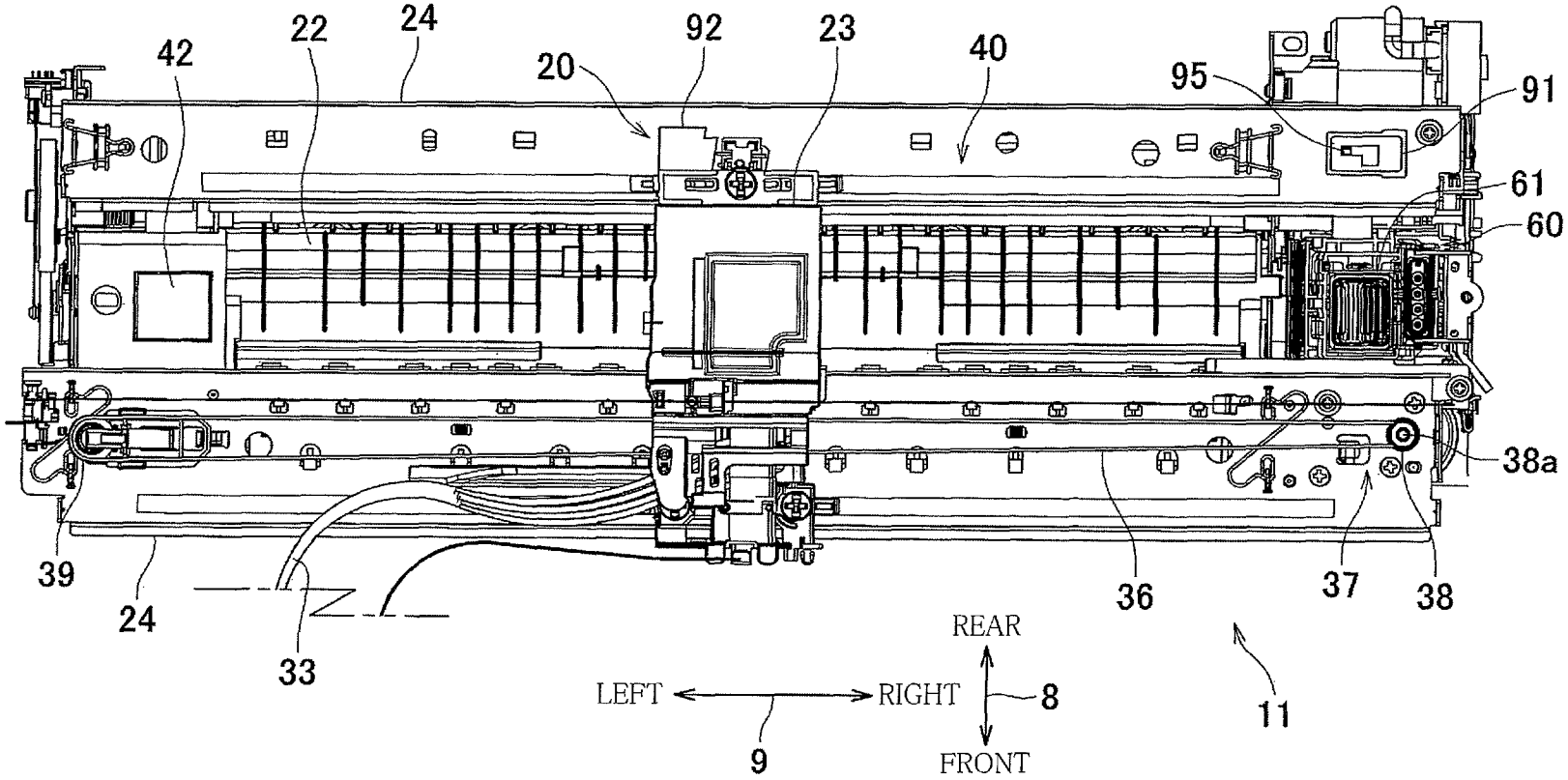
FIG. 4 is a plan view illustrating the printing unit illustrated in FIG. 1.

As illustrated in FIGS. 2 and 4, the recording device 20 includes a recording head 21 as one example of a liquid ejection head, a moving mechanism 40, and a platen 22. The moving mechanism 40 includes a carriage 23. The carriage 23 is reciprocated in a scanning direction which coincides with the right and left direction 9 and a direction perpendicular to the sheet conveying direction A. The recording head 21 is provided on the lower side of the carriage 23. A lower surface of the recording head 21 serves as an ejection surface 21*a* having a multiplicity of nozzles for ejecting ink onto the sheet P conveyed to a position just under the recording head 21. The platen 22 is disposed under the ejection surface 21*a* to support the sheet P conveyed by the conveying roller pair 55.

As illustrated in FIG. 4, inks of four colors, namely, cyan (C), magenta (M), yellow (Y), and black (K) are respectively supplied to the recording head 21 from ink tanks, not shown, via ink tubes 33, respectively. The controller 5 based on a print instruction controls the recording head 21 to eject fine ink droplets of the inks from the nozzles. That is, the recording head 21 is reciprocated over the sheet P by the reciprocation of the carriage 23 in the right and left direction 9, and the recording head 21 ejects the fine ink droplets of the inks from the nozzles during its reciprocation to record an image on the sheet P conveyed on the platen 22.

As illustrated in FIG. 4, the moving mechanism 40 includes a pair of guide rails 24 and a belt transmission mechanism 37. The pair of guide rails 24 are spaced apart from each other in the front and rear direction 8 and extend in the right and left direction 9 so as to be parallel with each other. The carriage 23 is disposed so as to be bridged between the pair of guide rails 24 and is reciprocated on the pair of guide rails 24 in the right and left direction 9.

The belt transmission mechanism 37 is disposed on an upper surface of a front one of the guide rails 24. The belt transmission mechanism 37 includes two pulleys 38, 39 and a timing belt 36. The pulley 38 is provided on a right end portion of the front guide rail 24, and a pulley 39 is provided on a left end portion of the front guide rail 24. The timing belt 36 is an endless belt looped over these pulleys 38, 39.

The shaft member 38*a* as one example of a first transmission mechanism is rotatably supported by the front guide rail 24. The shaft member 38*a* extends in the up and down direction 7. The pulley 38 is fitted on the shaft member 38*a* and rotated integrally with the shaft member 38*a*. Driving power (i.e., rotational power in a direction about an axis) generated by the carriage drive motor 201 is input to the shaft member 38*a*. As a result, the pulley 38 is rotated, which rotates the timing belt 36. The timing belt 36 is fixed to the carriage 23. Accordingly, the carriage 23 is reciprocated by the rotation of the timing belt 36. As thus described, the shaft member 38*a* transmits the driving power of the carriage drive motor 201 to the moving mechanism 40.

As illustrated in FIG. 4, a lever guide 91 is provided on a rear one of the guide rails 24. The lever guide 91 is fixed to the guide rail 24 by being fitted in a hole, not shown, formed in a right portion of the guide rail 24 (i.e., a portion of the guide rail 24 near a maintenance mechanism 60 which will be described below). The transmission mechanism 70 (see FIGS. 7A and 7B) as one example of a transmission mechanism and a second transmission mechanism is disposed under the lever guide 91. The lever guide 91 has a generally planar plate shape. Inside the lever guide 91, a guide hole 95 is formed so as to have a predetermined shape. An input portion 74*a* of an input lever 74 which will be described below is inserted in the guide hole 95 from a lower side thereof so as to protrude from an upper surface of the rear guide rail 24. When no external force is applied to the input portion 74*a* inserted in the guide hole 95, the input portion 74*a* is kept at a first power transmitting position (illustrated in FIG. 7A) at which the input portion 74*a* is held in contact with one of opposite end portions of the guide hole 95 which is located on an inner side of the MFP 10 than the other (i.e., on a left side in FIG. 4). In the present embodiment, when the input portion 74*a* is located at the first power transmitting position, a switching gear 71 which will be described below is located at a position at which the switching gear 71 can be meshed with the first output gear 81 (noted that this position may be hereinafter referred to as "first position").

As illustrated in FIG. 4, a guide piece 92 protruding rearward is provided on a rear end portion of the carriage 23. The guide piece 92 is reciprocated in the right and left direction 9 with the carriage 23. With the movement of the carriage 23, the guide piece 92 is brought into contact with the input portion 74*a* (see FIGS. 7A and 7B) protruding from the guide hole 95. More specifically, when the carriage 23 is moved rightward such that the recording head 21 is moved to a maintenance position at which the recording head 21 is opposed to a cap 61 which will be described below, the guide piece 92 pushes the input portion 74*a* rightward, so that the input lever 74 is moved to a second power transmitting position (illustrated in FIG. 7B). In the present embodiment, when the input portion 74*a* is located at the second power transmitting position, the switching gear 71 which will be described below is located at a position at which the switching gear 71 can be meshed with a second output gear 82 as one example of a second gear (noted that this position may be hereinafter referred to as "second position"). As thus described, the position of the input portion 74*a* can be selectively changed by controlling and changing the position of the carriage 23. When the input portion 74*a* of the input lever 74 is selectively moved to one of the predetermined positions (namely, the first power transmitting position and the second power transmitting position), the switching gear 71 which will be described below is moved to a position (i.e., the first position or the second position) corresponding to the position of the input portion 74*a*.

As illustrated in FIG. 4, a waste ink tray 42 is disposed on a left side of the platen 22. The waste ink tray 42 receives ink which is preliminarily ejected from the recording head 21 before a start of printing of the recording head 21 whose state has been returned from its standby state back to its operating state, for example. This preliminary ejection is what is called flushing. The recording head 21 performs the flushing as maintenance for removing air bubbles and color-mixed ink from the nozzles, for example. The waste ink tray 42 is covered with a felt. When the recording head 21 performs the flushing, the ink preliminarily ejected is absorbed into this felt.

Maintenance Mechanism 60

Figure 5A:
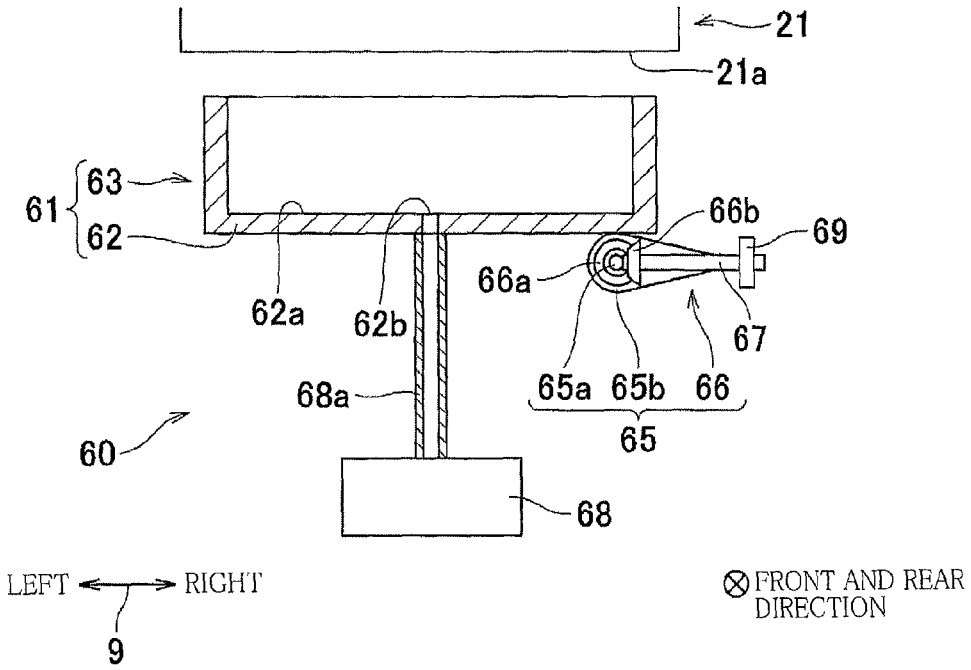
Figure 5B:
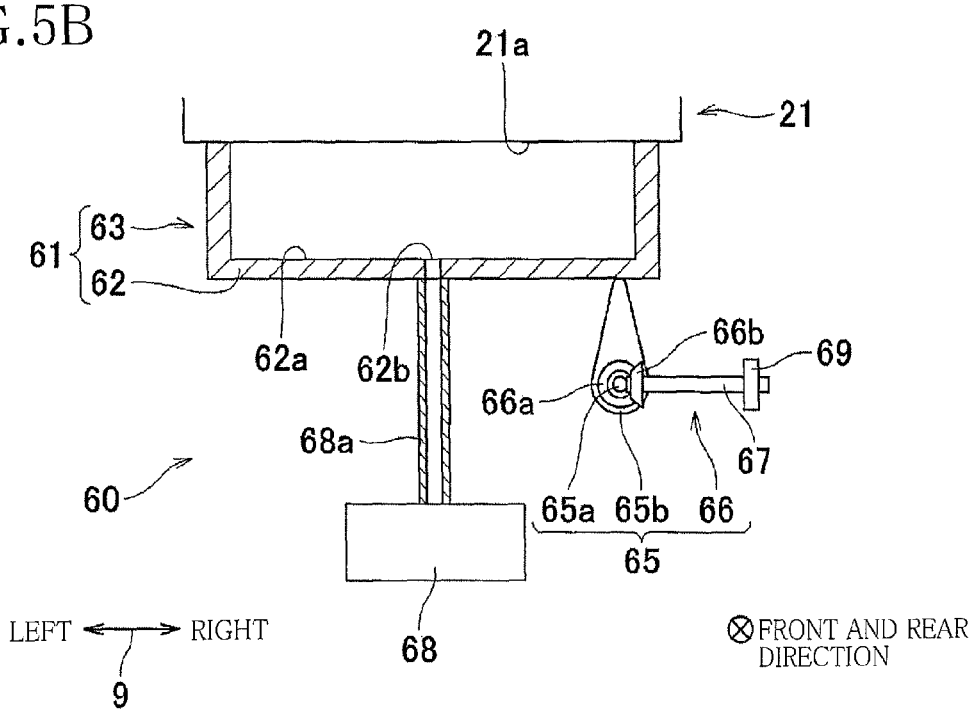

There will be next explained the maintenance mechanism 60 with reference to FIGS. 4, 5A, and 5B. The maintenance mechanism 60 prevents drying of ink in the nozzles formed in the ejection surface 21*a* and removes air bubbles and foreign matters from the nozzles. As illustrated in FIG. 4, the maintenance mechanism 60 is disposed on a right side of the platen 22. Specifically, the maintenance mechanism 60 is disposed at the maintenance position (as one example of a particular position) which is located on a right side of an area on which the sheet P conveyed on the platen 22 can pass, i.e., on a right side of the conveyance path 27 in the right and left direction 9. It is noted that the maintenance position is located on an opposite side of the conveyance path 27 in the right and left direction 9 from the flushing position at which the waste ink tray 42 is disposed. As illustrated in FIGS. 5A and 5B, the maintenance mechanism 60 includes the cap 61, a lift-up mechanism 65, and a suction pump 68.

As illustrated in FIGS. 5A and 5B, the cap 61 is formed of rubber, for example, and includes an integrally molded bottom wall portion 62 and a lip portion 63 standing upright on a peripheral portion of the bottom wall portion 62. In the present embodiment, both of the bottom wall portion 62 and the lip portion 63 are formed of rubber. However, as long as at least the lip portion 63 is formed of an elastic material, the other portions of the cap 61 may be formed of materials other than rubber such as polyacetal. The bottom wall portion 62 is shaped like a plate having a rectangular shape in plan view. The outer shape of the bottom wall portion 62 is slightly smaller than that of the ejection surface 21*a*. When the carriage 23 is moved to the maintenance position, an upper surface 62*a* of the bottom wall portion 62 is opposed to all the nozzles formed in the ejection surface 21*a*. The construction of the bottom wall portion 62 and the lip portion 63 forms a recessed shape of the cap 61 which is open in its upper side. The bottom wall portion 62 has a connection opening 62*b*. The connection opening 62*b* is formed at a generally center of the upper surface 62*a* and communicates with the inside of the cap 61.

As illustrated in FIGS. 5A and 5B, the lift-up mechanism 65 includes a shaft member 65*a*, a cam 65*b*, and a transmission mechanism 66, and the lift-up mechanism 65 is supported by a frame, not shown. The shaft member 65*a* extends in the front and rear direction 8. The cam 65*b* is fitted on the shaft member 65*a* and rotated integrally with the shaft member 65*a*. The cam 65*b* having a predetermined outline is disposed such that its outer peripheral surface is held in contact with the bottom wall portion 62. The transmission mechanism 66 includes two bevel gears 66*a*, 66*b*, a shaft member 67, and a gear 69. The bevel gear 66*a* is fitted on a front end portion of the shaft member 65*a* and rotated integrally with the shaft member 65*a*. The bevel gear 66*b* is fitted on a left end portion of the shaft member 67 and rotated integrally with the shaft member 67. The shaft member 67 extends in the right and left direction 9, and the two bevel gears 66*a*, 66*b* are meshed with each other. The gear 69 is fitted on a right end portion of the shaft member 67 and rotated integrally with the shaft member 67. The gear 69 is meshed with the second output gear 82 which will be described below.

When the driving power generated by forward rotation of the drive motor 202 is transmitted to the gear 69 via the transmission mechanism 70, the transmission mechanism 66 rotates the shaft member 65*a* and the cam 65*b* in the counterclockwise direction in FIGS. 5A and 5B. As illustrated in FIG. 5A, when the cam 65*b* is rotated by 90 degrees in the counterclockwise direction from the state illustrated in FIG. 5A in a state in which the ejection surface 21*a* is opposed to the cap 61 (that is, in the state in which the recording head 21 is located at the maintenance position), the cap 61 is pushed upward by an outside portion of the cam 65*b*. As a result, as illustrated in FIG. 5B, a state of the head 21 and the cap 61 is changed from a separated state in which the lip portion 63 is spaced apart from the ejection surface 21*a* to a contact state in which the lip portion 63 is held in contact with the ejection surface 21*a*. In this contact state, the cap 61 is in a sealing state in which the cap 61 seals off the nozzles formed in the ejection surface 21*a*, and a space defined by the ejection surface 21*a* and the cap 61 is sealed off from the outside. On the other hand, when driving power generated by reverse rotation of the drive motor 202 is transmitted to the gear 69 via the transmission mechanism 70, the transmission mechanism 66 rotates the shaft member 65*a* and the cam 65*b* in the clockwise direction in FIGS. 5A and 5B. When the cam 65*b* is rotated by 90 degrees in the clockwise direction from the state illustrated in FIG. 5B, as illustrated in FIG. 5A, the cap 61 is moved downward with movement of the outside portion of the cam 65*b*. As a result, the lip portion 63 is moved off the ejection surface 21*a*, so that the separated state is established. In this separated state, the cap 61 is in a non-sealing state in which the cap 61 does not seal off the nozzles formed in the ejection surface 21*a*. As thus described, the cap 61 and the lift-up mechanism 65 are one example of a second driven mechanism.

It is noted that the lift-up mechanism as a cap moving mechanism may have any construction as long as the lift-up mechanism can move the cap 61 upward and downward by the driving power transmitted from the drive motor 202.

The suction pump 68 is connected to the connection opening 62*b* via a flexible tube 68*a*. The tube 68*a* may not have flexibility and may be any hollow tube or pipe member. The suction pump 68 is a tube pump. When the suction pump 68 is driven in the state in which the ejection surface 21*a* is in the sealing state, the suction pump 68 reduces the pressure in the space defined by the ejection surface 21*a* and the cap 61, thereby discharging the ink from the nozzles communicating with the space (noted that this operation will be hereinafter referred to as "suction purging"). In the present embodiment, the suction pump 68 has a drive source, and the controller 5 controls the suction pump 68 to be driven. However, this MFP 10 may be configured such that the suction pump 68 does not have a drive source, the MFP 10 includes a transmission mechanism for transmitting the driving power of the drive motor 202 to the suction pump, and the drive motor 202 is driven to drive the suction pump. In this configuration, the suction pump and the transmission mechanism for transmitting the driving power to the suction pump are one example of the second driven mechanism.

Figure 6:
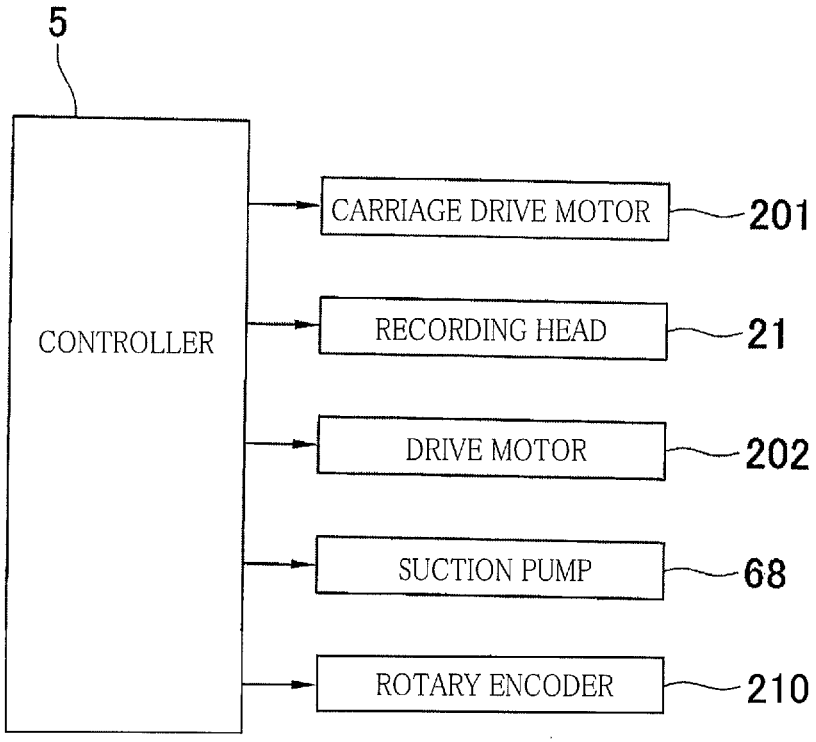
FIG. 6 is a block diagram illustrating an electric configuration of the printing unit.

As illustrated in FIG. 6, the controller 5 includes a central processing unit (CPU), a read only memory (ROM), a Random Access Memory (RAM), and an application specific integrated circuit (ASIC), which cooperate to control operations of the carriage drive motor 201, the recording head 21, the drive motor 202, the suction pump 68, and other devices. For example, the controller 5 controls the recording head 21, the carriage drive motor 201, the drive motor 202, and other devices, based on a print instruction transmitted from the PC, to record an image on the sheet P. Also, the controller 5 controls the carriage drive motor 201, the drive motor 202, the suction pump 68, and other devices to perform maintenance operations such as the capping of the ejection surface 21*a* (i.e., establishment of the sealing state) and the suction purging. The controller 5 includes a single CPU and a single ASIC in the present embodiment, but the controller 5 may include only a single CPU which executes required processings and may include a plurality of CPUs which selectively execute the required processings. Also, the controller 5 may include only a single ASIC which executes required processings and may include a plurality of ASICs which selectively execute the required processings.

There will be next explained the transmission mechanism 70 with reference to FIGS. 7A-9D. As illustrated in FIGS. 7A-8C, the transmission mechanism 70 includes the switching gear 71, three shaft members 72, 77, 83, an input gear 73, the first output gear 81, the second output gear 82, a coil spring 75, and a switching-gear moving mechanism 78 as one example of a switcher. The three shaft members 72, 77, 83 extend in the right and left direction 9 so as to be parallel with each other, and the shaft members 72, 77, 83 are supported by a frame, not shown. That is, the three shaft members 72, 77, 83 are arranged such that their respective central axes extending in the right and left direction 9 are parallel with each other. Only the shaft member 72 of the three shaft members 72, 77, 83 is rotatably supported by the frame. The shaft member 72 (as one example of a shaft member and a first shaft member) is rotated by the driving power of the drive motor 202 which is directly transmitted to the shaft member 72. That is, when the drive motor 202 is driven forward, as illustrated in FIG. 9A, the shaft member 72 is rotated in the counterclockwise direction, and when the drive motor 202 is driven reversely, as illustrated in FIG. 9C, the shaft member 72 is rotated in the clockwise direction.

The input gear 73 is supported by the shaft member 72 such that the input gear 73 is rotatable relative to the shaft member 72 by an amount corresponding to spaces which will be described later. The input gear 73 includes: a teeth-formed portion 73*a* provided with a plurality of teeth formed along a circumferential direction of the input gear 73; and a cylindrical portion 73*b* provided with no teeth. The width of the teeth-formed portion 73*a* in the right and left direction 9 is greater than that of the switching gear 71. More specifically, the teeth-formed portion 73*a* is formed so as to be meshed with the switching gear 71 even when the switching gear 71 is located any of the first position and the second position. The input gear 73 and the switching gear 71 are always meshed with each other, allowing transmission of rotational power to and from each other.

Figure 8A:
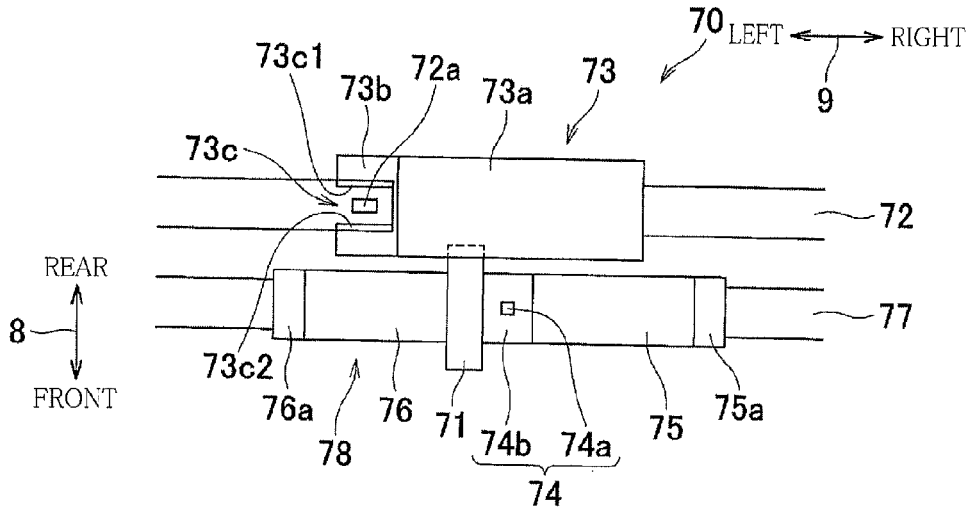
FIG. 8A is a plan view illustrating the transmission mechanism, with the switching gear located at the first position.
Figure 8B:
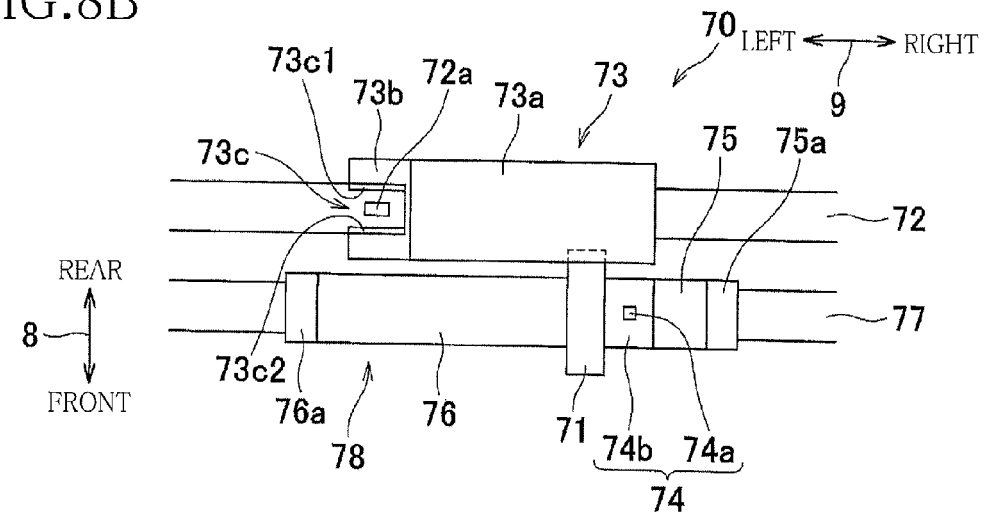
FIG. 8B is a plan view illustrating the transmission mechanism, with the switching gear located at the second position.
Figure 8C:
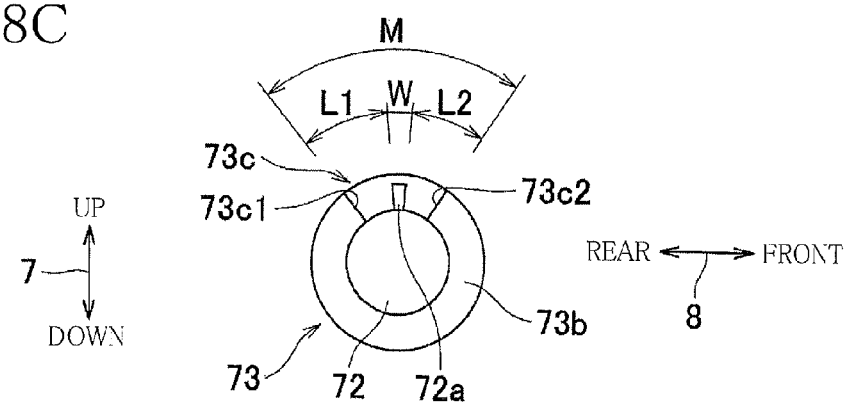
FIG. 8C is a side view illustrating an input gear and a shaft member therefor.

As illustrated in FIGS. 8A-8C, the cylindrical portion 73*b* has a cutout portion 73*c*. Since the cutout portion 73*c* is formed, the cylindrical portion 73*b* has a pair of faces 73*c*1, 73*c*25 spaced apart from each other and opposed to each other in a rotational direction of the shaft member 72 (i.e., a direction about an axis of the shaft member 72). The shaft member 72 has a contact portion 72*a* disposed in the cutout portion 73*c*. The contact portion 72*a* protrudes outward in a radial direction of the shaft member 72 from an outer peripheral surface of the shaft member 72. In the rotational direction of the shaft member 72, as illustrated in FIG. 8C, the width W of the contact portion 72*a* is less than half a separation distance M which is a distance between the pair of faces 73*c*1, 73*c*2 on a side near the contact portion 72*a*. Thus, the spaces or clearances each serving as play are formed in the cutout portion 73*c* at areas located between the contact portion 72*a* and the face 73*c*1 and between the contact portion 72*a* and the face 73*c*2 in the rotational direction of the shaft member 72, respectively. In FIG. 8C, L1 represents the length of the clearance between the contact portion 72*a* and the face 73*c*1 in the rotational direction, and L2 represents the length of the clearance between the contact portion 72*a* and the face 73*c*2 in the rotational direction. The lengths L1, L2 are generally equal to each other when the contact portion 72*a* is located at a generally center between the pair of faces 73*c*1, 73*c*2 in the rotational direction of the shaft member 72. The lengths L1, L2 in this state are determined such that the contact portion 72*a* and each of the pair of faces 73*c*1, 73*c*2 are not brought into contact with each other even when the input gear 73 meshed with the switching gear 71 which will be described below is rotated by rotation of the switching gear 71 by an angle corresponding to half pitch (½ pitches) of teeth 71*a* (see FIG. 10) of the switching gear 71. In the present embodiment, the lengths L1, L2 in the state in which the contact portion 72*a* is located at the generally center between the pair of faces 73*c*1, 73*c*2 in the rotational direction of the shaft member 72 are determined such that the contact portion 72*a* and any one of the pair of faces 73*c*1, 73*c*2 are brought into contact with each other when the input gear 73 is rotated relative to the shaft member 72 by rotation of the switching gear 71 by an angle corresponding to one pitch of the teeth 71*a* of the switching gear 71. In this construction, when the shaft member 72 is rotated, the contact portion 72*a* is brought into contact with any one of the pair of faces 73*c*1, 73*c*2, so that the input gear 73 is rotated with the shaft member 72 in the same direction.

It is noted that in the case where at least one other output gear is provided between the first output gear 81 and the second output gear 82, and it is assumed that the number of output gears including the first output gear 81 and the second output gear 82 is n (where n is a natural number), the lengths L1, L2 may be determined such that the contact portion 72*a* is brought into contact with any one of the pair of faces 73*c*1, 73*c*2 when the input gear 73 is rotated by rotation of the switching gear 71 by equal to or larger than an angle corresponding to a value obtained by multiplying (n−1) by the half pitch of the teeth 71*a* of the switching gear 71.

The switching gear 71 is supported by the shaft member 77 such that the switching gear 71 is rotatable relative to the shaft member 77 so as to be movable in the axial direction of the shaft member 77 (i.e., in the right and left direction 9). The shaft member 77 is inserted in the coil spring 75 (as one example of an urging mechanism), and the coil spring 75 is supported by the shaft member 77 such that the coil spring 75 can be extended and compressed in the right and left direction 9. The coil spring 75 is disposed on a right side of the switching gear 71. The shaft member 77 (as one example of a second shaft member) includes a fixing portion 75*a* for fixing a right end portion of the coil spring 75 to the shaft member 77.

The switching-gear moving mechanism 78 includes the input lever 74 and a coil spring 76. The input lever 74 includes: the input portion 74*a*; and a cylindrical portion 74*b* supported by the shaft member 77 so as to be movable in the axial direction. The cylindrical portion 74*b* is disposed between the switching gear 71 and the coil spring 75 in the right and left direction 9. The input portion 74*a* protrudes upward from an outer peripheral surface of the cylindrical portion 74*b*. A distal end portion of the input portion 74*a* protrudes upward from the guide hole 95 so as to be contactable with the guide piece 92. The shaft member 77 is inserted in the coil spring 76, and the coil spring 76 is supported by the shaft member 77 such that the coil spring 76 can be extended and compressed in the right and left direction 9. The coil spring 76 is disposed on the left side of the switching gear 71. The shaft member 77 includes a fixing portion 76*a* for fixing a left end portion of the coil spring 76 to the shaft member 77.

Figure 7A:
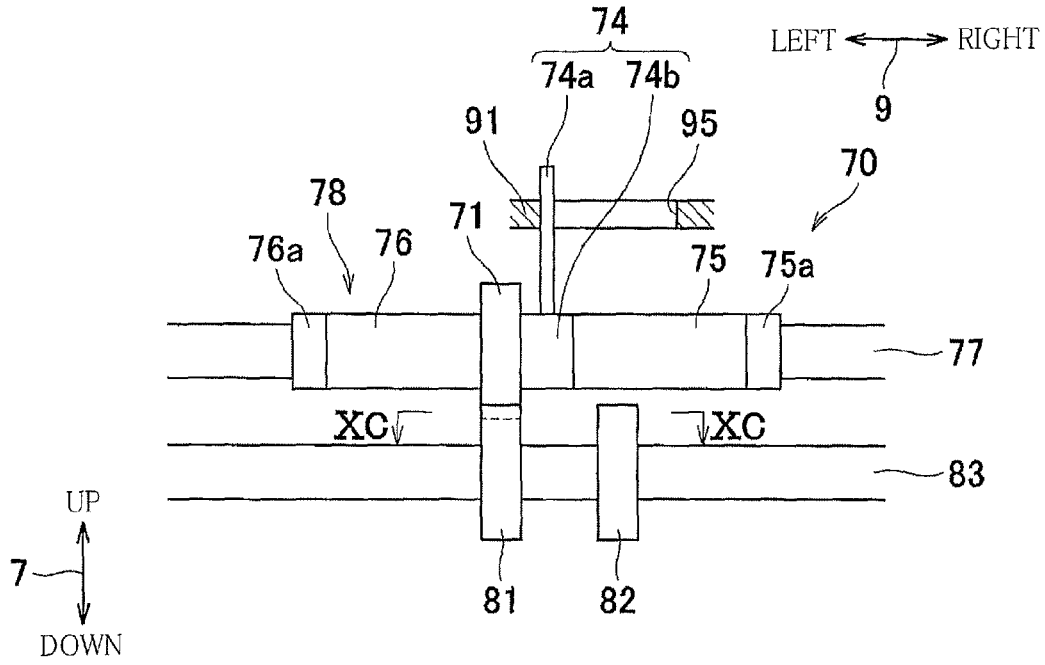
Figure 7B:
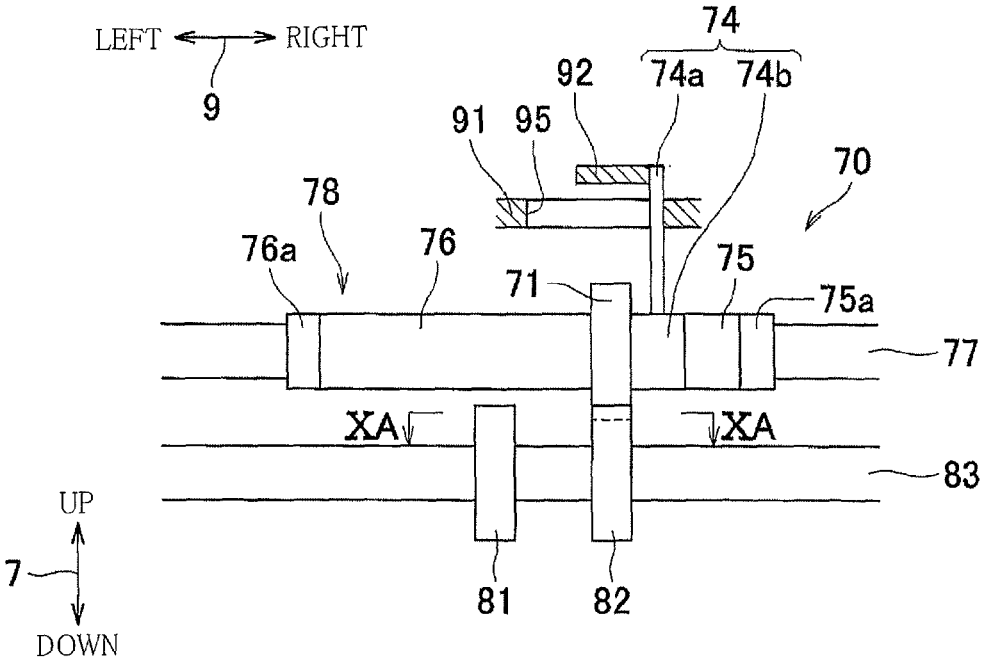
Figure 9A:
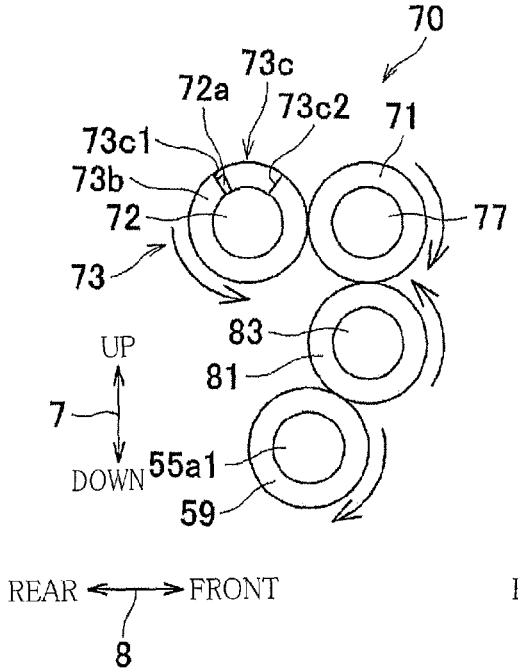
Figure 9B:
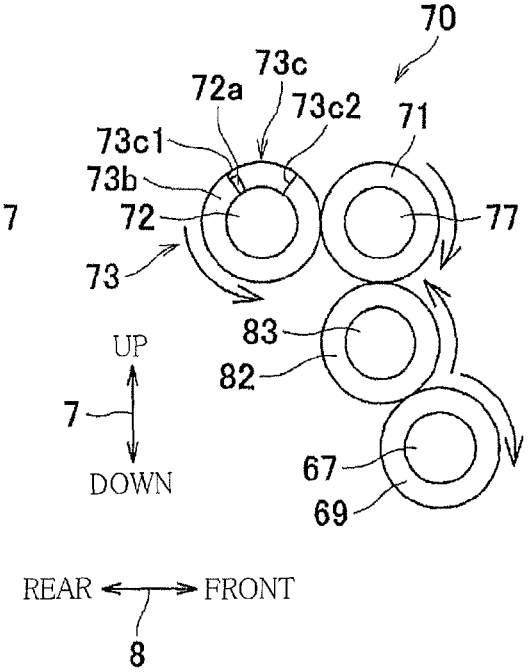

As illustrated in FIGS. 7A and 7B, the first output gear 81 and the second output gear 82 are supported by the shaft member 83 so as to be rotatable relative to the shaft member 83 in a state in which the first output gear 81 and the second output gear 82 are arranged in the axial direction of the shaft member 83 (i.e., in the right and left direction 9). In the present embodiment, the size, shape, and so on of each of the first and second output gears 81, 82 are the same as those of the switching gear 71. The shaft member 83 is disposed under the shaft member 77. This configuration allows each of the first output gear 81 and the second output gear 82 to be meshed with the switching gear 71 on the lower side of the switching gear 71. As illustrated in FIG. 9A, the first output gear 81 is meshed with the gear 59. As illustrated in FIG. 9B, the second output gear 82 is meshed with the gear 69. It is noted that, as illustrated in FIGS. 9A-9D, the gear 59 and the gear 69 are arranged at different positions in the front and rear direction 8. Thus, the shaft member 55*a*1 and the shaft member 67 do not interfere with each other.

As illustrated in FIG. 7A, when the input portion 74*a* is not pushed by the guide piece 92, that is, when the recording head 21 is located at a position different from the maintenance position (e.g., the flushing position or the position at which the recording head 21 and the platen 22 are opposed to each other), each of the two coil springs 75, 76 is compressed (in a state in which an urging force generated by the compressed coil spring 75 is larger than an urging force generated by the compressed coil spring 76) to keep the input portion 74*a* at the first power transmitting position at which the input portion 74*a* is held in contact with the left end portion of the guide hole 95. In this state, the switching gear 71 is located at the first position at which the first position is meshed with the first output gear 81. When the recording head 21 is moved to the maintenance position, and thereby the input portion 74*a* is pushed by the guide piece 92 and positioned at the second power transmitting position at which the input portion 74*a* is held in contact with the right end portion of the guide hole 95, as illustrated in FIG. 7B, the input lever 74 further compresses the coil spring 75, so that an urging force of the coil spring 75 is not applied to the switching gear 71 but is applied to the input portion 74*a* (the cylindrical portion 74*b*). In this operation, the coil spring 76 extends rightward to push the switching gear 71 rightward, so that the switching gear 71 is positioned at the second position at which the switching gear 71 is meshed with the second output gear 82.

When conveying the sheet P from the sheet-supply tray 15, the drive motor 202 is driven forward, with the switching gear 71 located at the first position. In this operation, as illustrated in FIG. 9A, the shaft member 72, the input gear 73, the switching gear 71, the first output gear 81, and the gear 59 are rotated in directions indicated by the respective arrows in FIG. 9A. As a result, the sheet-supply roller 31 is rotated to supply the sheet P from the sheet-supply tray 15 into the conveyance path 27 as described above. In this operation, the conveying roller 55*a* and the sheet-discharge roller 56*a* are also rotated, and thereby the sheet P supplied from the sheet-supply tray 15 is conveyed by the conveying roller pair 55 and the sheet-discharge roller pair 56.

Figure 9C:
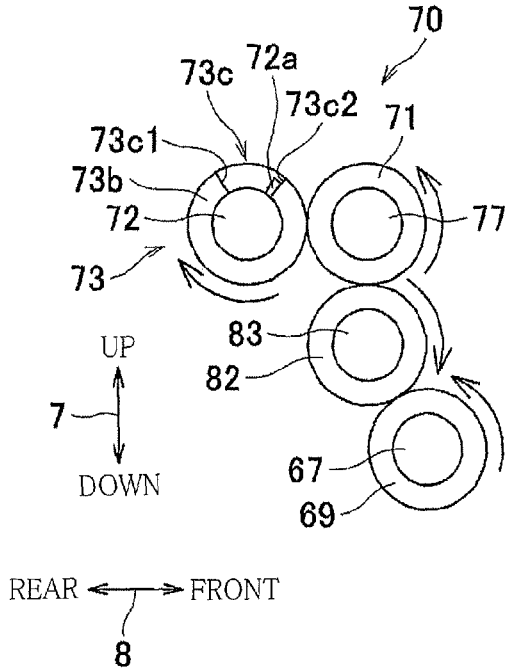

When changing the ejection surface 21*a* of the recording head 21 to the sealing state, the drive motor 202 is driven forward, with the switching gear 71 located at the second position. In this operation, as illustrated in FIG. 9B, the shaft member 72, the input gear 73, the switching gear 71, the second output gear 82, and the gear 69 are rotated in directions indicated by the respective arrows in FIG. 9B. As a result, the shaft member 65*a* and the cam 65*b* are rotated by the transmission mechanism 66 to change the cap 61 to the sealing state in which the cap 61 seals off the nozzles formed in the ejection surface 21*a* as described above. On the other hand, when the ejection surface 21*a* of the recording head 21 is changed from the sealing state to the non-sealing state, the drive motor 202 is driven reversely, with the switching gear 71 located at the second position. In this operation, as illustrated in FIG. 9C, the shaft member 72, the input gear 73, the switching gear 71, the second output gear 82, and the gear 69 are rotated in directions indicated by the respective arrows in FIG. 9C. As a result, the shaft member 65*a* and the cam 65*b* are rotated by the transmission mechanism 66 to change the cap 61 to the non-sealing state in which the cap 61 does not seal off the nozzles formed in the ejection surface 21*a* as described above.

There will be next explained, with reference to FIGS. 7A, 7B, and 9A-10C, operations performed when the standby state is released and printing is performed. The standby state refers to a state in which in the case where the printing unit 11 is not used for a predetermined length of time, the cap 61 is in the sealing state in which the cap 61 seals off the ejection surface 21*a* to prevent drying of the ink in the nozzles formed in the ejection surface 21*a*. The standby state also refers to a state in which the cap 61 seals off the ejection surface 21*a* and waits for a print instruction after the ink is forced into the cap 61 in the suction purging and discharged to a waste ink tank, not shown. When establishing the standby state, the recording head 21 is positioned at the maintenance position as described above, and the switching gear 71 is positioned at the second position as illustrated in FIG. 7B. When having received a print instruction from the PC, the controller 5 controls the drive motor 202 to be driven reversely. Consequently, as illustrated in FIG. 9C, the second output gear 82 and the gear 69 are rotated to move the cap 61 off the ejection surface 21*a*, establishing the non-sealing state.

Figure 9D:
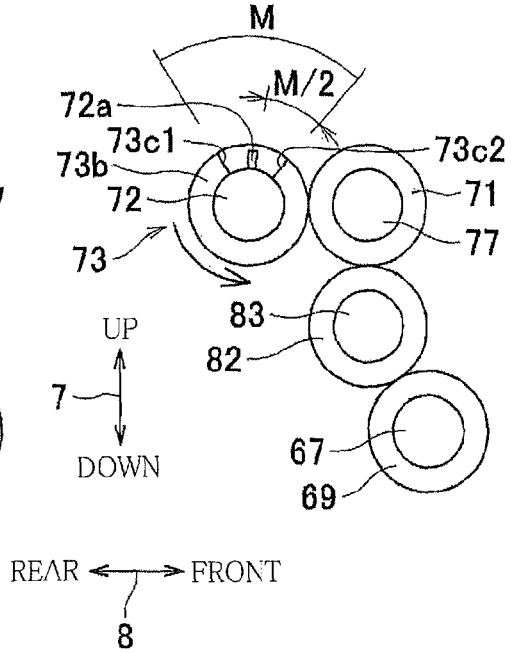

The controller 5 thereafter controls the drive motor 202 to drive the drive motor 202 forward such that as illustrated in FIG. 9D the contact portion 72*a* is positioned at the generally center between the pair of faces 73*c*1, 73*c*2. More specifically, as illustrated in FIG. 9C, the contact portion 72*a* is held in contact with the face 73*c*2 when changing the cap 61 from the sealing state to the non-sealing state. Thus, when the drive motor 202 is driven forward, the shaft member 72 is rotated so as to move the contact portion 72*a* from the face 73*c*2 toward the face 73*c*1. An amount or an angle of this rotation of the shaft member 72 is adjusted to an angle corresponding to a distance which is half a distance obtained by subtracting the width W of the contact portion 72*a* from the separation distance M between the pair of faces 73*c*1, 73*c*2 in the rotational direction of the shaft member 72. This adjustment can position the contact portion 72*a* at the generally center between the pair of faces 73*c*1, 73*c*2.

The controller 5 then controls the carriage drive motor 201 to move the recording head 21 to the flushing position. In the present embodiment, the controller 5 controls the drive motor 202 and then controls the carriage drive motor 201 to position the contact portion 72*a* at the generally center between the pair of faces 73*c*1, 73*c*2. However, in the case where the contact portion 72*a* can be moved to the generally center between the pair of faces 73*c*1, 73*c*2 before the recording head 21 reaches the flushing position, driving of the carriage drive motor 201 may be started prior to the drive motor 202, and drivings of the drive motor 202 and the carriage drive motor 201 may be started at the same time. With this configuration, the contact portion 72*a* can be moved to the generally center between the pair of faces 73*c*1, 73*c*2 before the recording head 21 is moved to the flushing position to perform flushing which is performed before printing which will be described below.

Figures 10A, 10B, 10C:
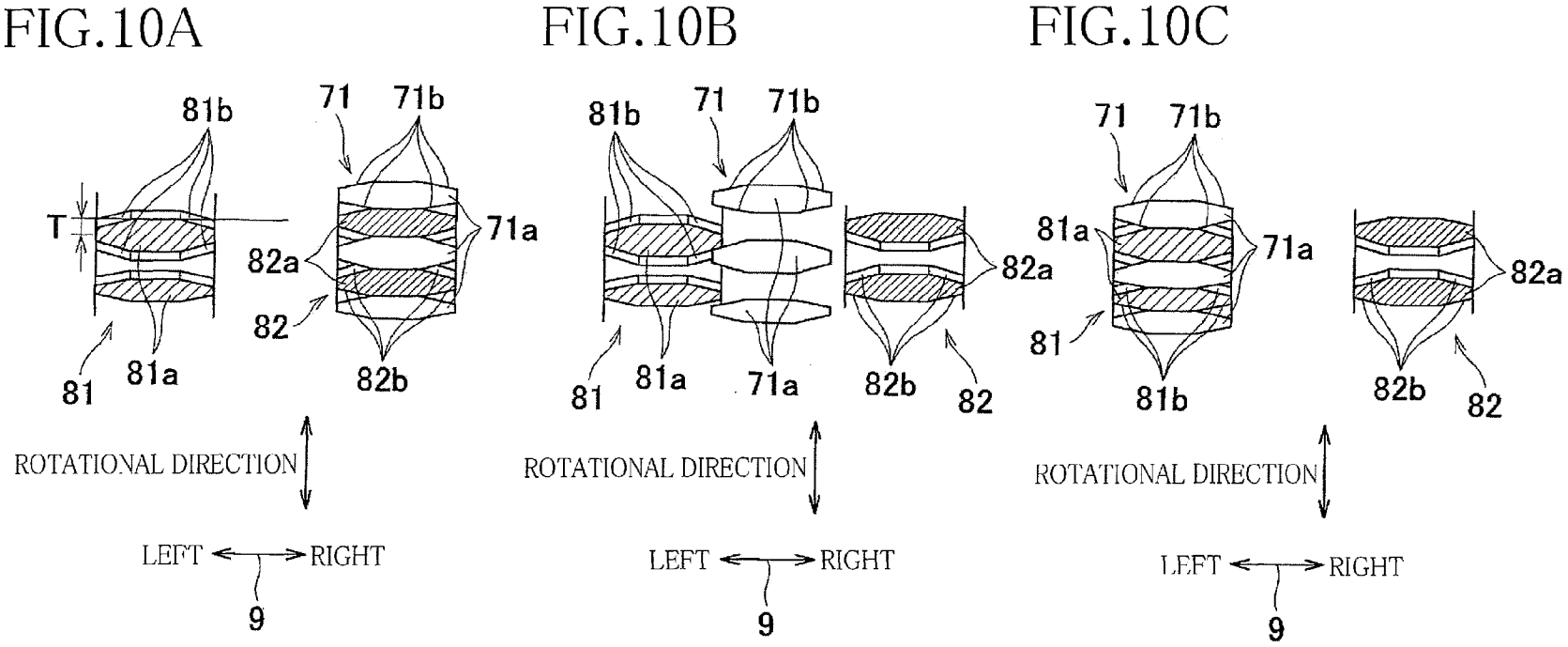

When the recording head 21 is moved from the maintenance position to the flushing position, the guide piece 92 ceases pushing the input lever 74 rightward. As a result, the coil spring 75 urges the switching gear 71 against an urging force of the coil spring 76 so as to move the switching gear 71 from the second position to the first position. Movement of the switching gear 71 in this operation will be next explained with reference to FIGS. 10A-10C. In FIGS. 10A-10C, only the switching gear 71 is not hatched while the first and second output gears 81, 82 are hatched for easy understanding of the types of gears.

As illustrated in FIGS. 10A-10C, each of the teeth 71*a* of the gear 71 has tapered portions 71*b* respectively at opposite end portions of each tooth 71*a* in the right and left direction, and each tapered portion 71*b* is formed at a corner portion of the tooth 71*a* which is defined by its surface extending along the rotational direction and its surfaces extending along the right and left direction. Likewise, each of teeth 81*a* of the gear 81 has tapered portions 81*b*, and each of teeth 82*a* of the gear 82 has tapered portions 82*b*. When the switching gear 71 is located at the second position, as illustrated in FIG. 10A, each of the teeth 71*a* of the switching gear 71 is positioned between corresponding two of the teeth 82*a* of the second output gear 82, so that the switching gear 71 and the second output gear 82 are meshed with each other. In this state, as illustrated in FIG. 10A, the teeth 81*a* of the first output gear 81 and the teeth 82*a* of the second output gear 82 may be misaligned from each other along the rotational direction by an angle corresponding to a particular distance T, for example. When the switching gear 71 is moved leftward (from the second position to the first position) in this state, as illustrated in FIG. 10B, the tapered portions 71*b* of the teeth 71*a* of the switching gear 71 are respectively brought into contact with the tapered portions 81*b* of the teeth 81*a* of the first output gear 81. Since the clearances having the lengths L1, L2 each serving as the play are formed between the contact portion 72*a* and the pair of faces 73*c*1, 73*c*2 in the rotational direction of the shaft member 72 (see FIG. 8C), the switching gear 71 can be rotated by an angle corresponding to the length L1 or L2. Accordingly, as illustrated in FIG. 10C, the switching gear 71 is moved leftward while each of the teeth 71*a* of the switching gear 71 is moved in the rotational direction so as to enter an area between corresponding two of the teeth 81*a* of the first output gear 81. As thus described, the switching gear 71 is moved to the first position at which the switching gear 71 and the first output gear 81 are meshed with each other. Immediately after the guide piece 92 ceases pushing the input lever 74 rightward (before the recording head 21 reaches the flushing position), the movement of the switching gear 71 to the first position is finished.

It is noted that when the recording head 21 is moved from a position different from the maintenance position to the maintenance position, that is, when the switching gear 71 is moved from the first position to the second position, the controller 5 controls the drive motor 202 to position the contact portion 72*a* at the generally center between the pair of faces 73*c*1, 73*c*2 before the recording head 21 reaches the maintenance position. With this operation, each of the teeth 71*a* of the switching gear 71 is moved rightward while moving in the rotational direction so as to enter the area between corresponding two of the teeth 82*a* of the second output gear 82 as in the case where the switching gear 71 is moved from the second position to the first position. As a result, the switching gear 71 is moved to the second position at which the switching gear 71 and the second output gear 82 are meshed with each other.

When the recording head 21 reaches the flushing position, the controller 5 controls the recording head 21 to perform the flushing in which ink is preliminarily ejected onto the waste ink tray 42.

The controller 5 thereafter controls the drive motor 202 to be driven forward. As a result, the sheet-supply roller 31 is rotated to supply the sheet P from the sheet-supply tray 15 into the conveyance path 27. In this operation, the conveying roller 55*a* and the sheet-discharge roller 56*a* are also rotated, and thereby the sheet P supplied from the sheet-supply tray 15 is conveyed by the conveying roller pair 55 and the sheet-discharge roller pair 56. The controller 5 also controls the carriage drive motor 201 and the recording head 21 based on the print instruction to record a desired image on the sheet P conveyed by the conveying roller pair 55. The sheet P on which the image has been recorded is discharged onto the sheet-output tray 16, so that the recording operation after the release of the standby state is finished.

In the MFP 10 described above, when the recording head 21 is moved by the moving mechanism 40 from the maintenance position to a position different from the maintenance position (e.g., the flushing position or the position at which the recording head 21 and the platen 22 are opposed to each other), the switching gear 71 is moved by the coil spring 75 from the second position toward the first position. In this movement, since the spaces each serving as the play are formed between the contact portion 72*a* (the shaft member 72) and the input gear 73 in the rotational direction, the switching gear 71 is rotatable by the length L1 or L2. Thus, even when the first output gear 81 is not located at the position at which the first output gear 81 is meshed with the switching gear 71, the switching gear 71 can be rotated so as to be meshed with the first output gear 81 while being moved from the second position to the first position. Accordingly, there is no need to perform a rocking operation for driving the drive motor 202 to rotate the switching gear 71 in order to mesh the switching gear 71 and the first output gear 81 with each other, thereby reducing a length of time required for meshing the switching gear 71 with the first output gear 81. As a result, it is possible to reduce a length of time required from reception of a print instruction in the standby state in which the recording head 21 is covered with the cap 61, to discharging of the printed sheet P.

The input gear 73 has the pair of faces 73*c*1, 73*c*2, the shaft member 72 has the contact portion 72*a*, and the spaces each serving as the play are formed between the contact portion 72*a* and the pair of faces 73*c*1, 73*c*2 in the rotational direction of the shaft member 72. This construction can easily form the play between the shaft member 72 and the input gear 73.

As a modification, the shaft member 72 may have a groove which forms a pair of faces spaced apart from and opposed to each other in the rotational direction of the shaft member 72. In this case, the input gear 73 only needs to have a contact portion protruding inward in the radial direction and to be located in the groove of the shaft member 72. This construction can also obtain the same effects as obtained in the above-described embodiment.

The controller 5 changes the rotation of the drive motor 202 from the reverse rotation for establishing the non-sealing state of the cap 61 to the forward rotation to move the contact portion 72*a* off one of the pair of faces 73*c*1, 73*c*2 during a period extending from the point in time when the second output gear 82 is rotated to establish the non-sealing state of the ejection surface 21*a* to the point in time when the recording head 21 reaches the flushing position. Thus, even in the case where the teeth 81*a* of the first output gear 81 and the teeth 82*a* of the second output gear 82 are misaligned from each other along the rotational direction by the angle corresponding to the particular distance T, that is, the first output gear 81 is not located at a position at which the first output gear 81 can be meshed with the switching gear 71 only by leftward movement of the switching gear 71, the switching gear 71 can be effectively rotated while being moved leftward (from the second position to the first position) so as to be meshed with the first output gear 81. In this operation, the controller 5 controls the drive motor 202 to move the contact portion 72*a* to the generally center between the pair of faces 73*c*1, 73*c*2. Accordingly, the switching gear 71 can be effectively rotated while being moved leftward so as to be meshed with the first output gear 81.

In the above-described embodiment, the spaces are formed between the shaft member 72 and the input gear 73, each as the play allowing the switching gear 71 to be rotated so as to be meshed with the first output gear 81 when the recording head 21 is moved from the maintenance position to a position different from the maintenance position, and the switching gear 71 is moved from the second position to the first position. However, the MFP 10 may be configured such that a planetary gear 85 is provided between the first output gear 81 (as one example of a sun gear) and the gear 59 (as one example of a third gear and an intermediate gear), and when the switching gear 71 is moved from the second position to the first position, the first output gear 81 can be rotated so as to be meshed with the switching gear 71.

Figure 11A:
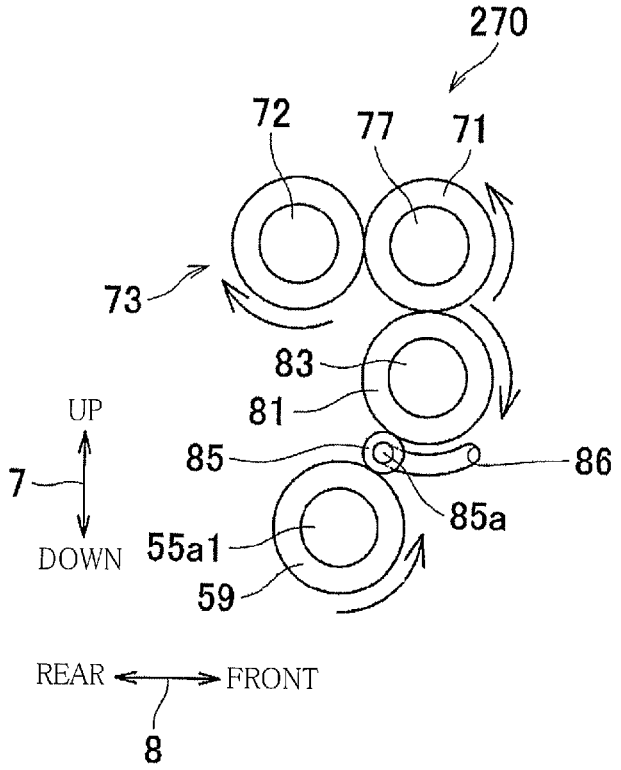

As illustrated in FIG. 11, a transmission mechanism 270 in this first modification is configured such that the above-described spaces are not formed between the input gear 73 and the shaft member 72, and the rotation of the shaft member 72 rotates the input gear 73 integrally. It is noted that the same reference numerals as used in the above-described embodiment are used to designate the corresponding elements of this first modification, and an explanation of which is dispensed with. The planetary gear 85 (as one example of a fourth gear) of the transmission mechanism 270 is always meshed with the first output gear 81. The planetary gear 85 is rotatably supported via a shaft member 85*a* by a groove 86 formed in the frame, not shown. The groove 86 supports the planetary gear 85 such that the planetary gear 85 is movable within a predetermined area around the first output gear 81 in the state in which the planetary gear 85 is meshed with the first output gear 81. More specifically, when the drive motor 202 is driven reversely, as illustrated in FIG. 11A, the shaft member 72, the input gear 73, the switching gear 71, and the first output gear 81 are rotated in directions indicated by the respective arrows in FIG. 11A. In this rotation, the groove 86 guides the planetary gear 85 such that the planetary gear 85 is moved by the rotation of the first output gear 81 to a power transmitting position (as one example of a third position) at which the planetary gear 85 is meshed with the gear 59. That is, the rotation of the first output gear 81 in the clockwise direction (as one example of a first rotational direction) moves the planetary gear 85 in the rotational direction to the power transmitting position. The driving power (i.e., the rotational power) of the drive motor 202 which is transmitted from the first output gear 81 is transmitted to the gear 59 via the planetary gear 85. As a result, the sheet P is conveyed by the sheet-supply roller 31, the conveying roller pair 55, and the sheet-discharge roller pair 56. It is noted that the drive motor 202 is driven reversely to convey the sheet P in the present modification, but in the case where another gear is provided between the planetary gear 85 and the gear 59, the drive motor 202 is driven forward to convey the sheet P as in the above-described embodiment.

Figure 11B:
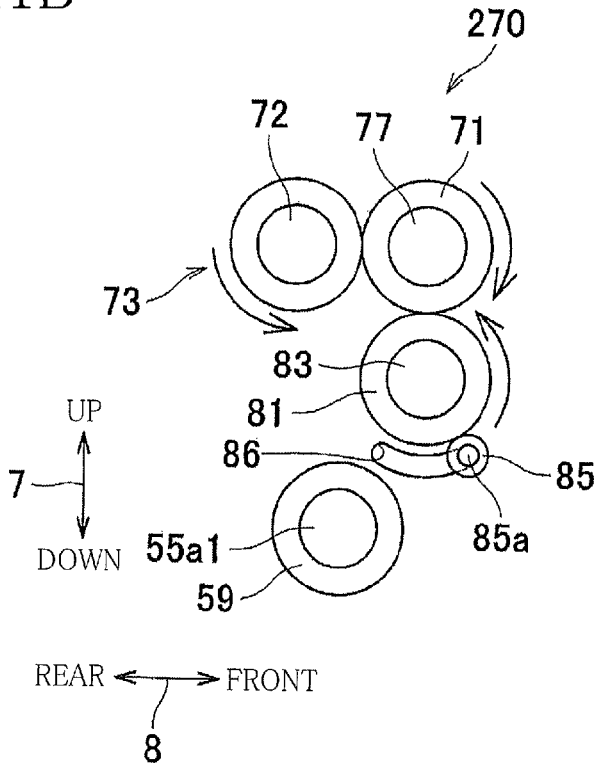

On the other hand, when the drive motor 202 is driven forward, as illustrated in FIG. 11B, the shaft member 72, the input gear 73, the switching gear 71, and the first output gear 81 are rotated in directions indicated by the respective arrows in FIG. 11B. In this rotation, the groove 86 guides the planetary gear 85 such that the planetary gear 85 is moved by the rotation of the first output gear 81 to a separated position (as one example of a fourth position) at which the planetary gear 85 is spaced apart from the gear 59. That is, the rotation of the first output gear 81 in the counterclockwise direction (as one example of a second rotational direction) moves the planetary gear 85 in the rotational direction to the separated position. The driving power (i.e., the rotational power) of the drive motor 202 which is transmitted from the first output gear 81 is not transmitted to the gear 59.

In the present modification, the controller 5 controls the drive motor 202 to be driven forward during a period extending from the end of the conveyance and so on of the sheet P which are caused by the reverse rotation of the drive motor 202, to the point in time when the recording head 21 reaches the maintenance position. In this control, in the present modification, the controller 5 controls the drive motor 202 to cause generally half rotation of the first output gear 81. As a result, the planetary gear 85 is moved from the power transmitting position illustrated in FIG. 11A to the separated position illustrated in FIG. 11B. It is noted that in the case where the planetary gear 85 can be moved from the power transmitting position to the separated position, the first output gear 81 may be rotated by less than or greater than its half rotation.

Moving the planetary gear 85 to the separated position as described above establishes a state in which the first output gear 81 is rotatable so as to be meshed with the switching gear 71. That is, as in the above-described embodiment, when having received the print instruction in the standby state, the controller 5 controls the drive motor 202 and the carriage drive motor 201 to establish the non-sealing state and then move the recording head 21 from the maintenance position to the flushing position. As a result of this movement of the recording head 21 to the flushing position, the guide piece 92 ceases pushing the input lever 74 rightward, and the switching gear 71 is moved from the second position to the first position. In this movement, as in the above-described embodiment, as illustrated in FIG. 10B, even when the tapered portions 71*b* of the teeth 71*a* of the switching gear 71 are respectively brought into contact with the tapered portions 81*b* of the teeth 81*a* of the first output gear 81, the first output gear 81 is in a state in which the first output gear 81 is rotatable together with the planetary gear 85, and accordingly the first output gear 81 and the planetary gear 85 are rotated with the leftward movement of the switching gear 71 such that each of the teeth 71*a* of the switching gear 71 enters an area between corresponding two of the teeth 81*a* of the first output gear 81. As a result, the switching gear 71 is moved to the first position at which the switching gear 71 and the first output gear 81 are meshed with each other. Also in the present modification, immediately after the guide piece 92 ceases pushing the input lever 74 rightward (before the recording head 21 reaches the flushing position), the movement of the switching gear 71 to the first position is finished.

Also in the present modification described above, when the recording head 21 is moved by the moving mechanism 40 from the maintenance position to a position different from the maintenance position (e.g., the flushing position), the switching gear 71 is moved by the coil spring 75 from the second position toward the first position. In this movement, when the planetary gear 85 is located at the separated position, the first output gear 81 is in its rotatable state. Thus, even when the first output gear 81 is not located at the position at which the first output gear 81 is meshed with the switching gear 71, the switching gear 71 can be rotated so as to be meshed with the first output gear 81 while being moved from the second position to the first position. Accordingly, there is no need to perform the rocking operation for driving the drive motor 202 to rotate the switching gear 71 in order to mesh the switching gear 71 and the first output gear 81 with each other, thereby reducing the length of time required for meshing the switching gear 71 with the first output gear 81. As a result, it is possible to reduce the length of time required from the reception of the print instruction in the standby state in which the recording head 21 is covered with the cap 61, to the discharging of the printed sheet P.

The planetary gear 85 is meshed with the gear 59 at the power transmitting position and spaced apart from the gear 59 at the separated position. With this configuration, when the planetary gear 85 is located at the power transmitting position, the driving power can be reliably transmitted to the gear 59, and when the planetary gear 85 is located at the separated position, the planetary gear 85 is reliably in a state in which the planetary gear 85 is rotatable together with the first output gear 81.

As a second modification, the planetary gear 85 and three gears 87-89 may be provided between the first output gear 81 and the gear 59. As in the first modification, a transmission mechanism 370 in this second modification is configured such that the rotation of the shaft member 72 rotates the input gear 73 integrally. It is noted that the same reference numerals as used in the above-described embodiment and first modification are used to designate the corresponding elements of this second modification, and an explanation of which is dispensed with.

Figure 12A:
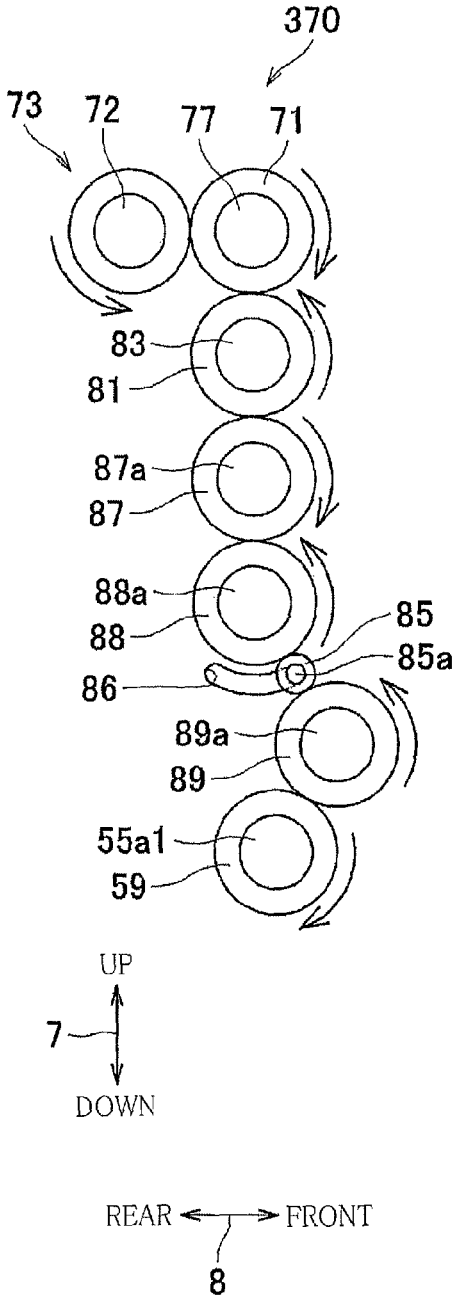

The gear 87 of the transmission mechanism 370 is rotatably supported by a shaft member 87*a* in a state in which the gear 87 is meshed with the first output gear 81. The gear 88 (as another example of a fourth gear and a sun gear) is rotatably supported by a shaft member 88*a* in a state in which the gear 88 is meshed with the gear 87. The planetary gear 85 (as one example of a fifth gear) is always meshed with the gear 88. The gear 89 as one example of an intermediate gear is rotatably supported by a shaft member 89*a* in a state in which the gear 89 is meshed with the gear 59. The planetary gear 85 is rotatably supported via the shaft member 85*a* by the groove 86 as described above. More specifically, when the drive motor 202 is driven forward, as illustrated in FIG. 12A, the shaft member 72, the input gear 73, the switching gear 71, the first output gear 81, and the two gears 87, 88 are rotated in directions indicated by the respective arrows in FIG. 12A. In this rotation, the groove 86 guides the planetary gear 85 such that the planetary gear 85 is moved by the rotation of the gear 88 to a power transmitting position (as another example of the third position) at which the planetary gear 85 is meshed with the gear 89. That is, the rotation of the gear 88 in the counterclockwise direction (as another example of the first rotational direction) moves the planetary gear 85 in the rotational direction to the power transmitting position. The driving power (i.e., the rotational power) of the drive motor 202 which is transmitted from the gear 88 is transmitted to the gear 89 via the planetary gear 85. The driving power (i.e., the rotational power) of the drive motor 202 is then transmitted from the gear 89 to the gear 59. As a result, the sheet P is conveyed by the sheet-supply roller 31, the conveying roller pair 55, and the sheet-discharge roller pair 56.

Figure 12B:
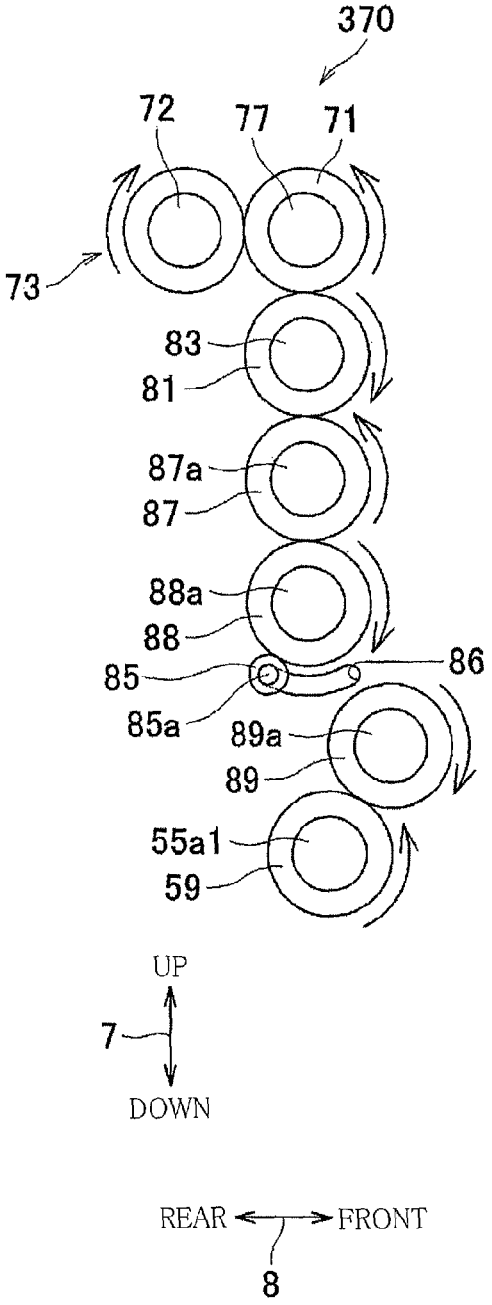

On the other hand, when the drive motor 202 is driven reversely, as illustrated in FIG. 12B, the shaft member 72, the input gear 73, the switching gear 71, the first output gear 81, and the two gears 87, 88 are rotated in directions indicated by the respective arrows in FIG. 12B. In this rotation, the groove 86 guides the planetary gear 85 such that the planetary gear 85 is moved by the rotation of the gear 88 to a separated position (as another example of the fourth position) at which the planetary gear 85 is spaced apart from the gear 89. That is, the rotation of the gear 88 in the clockwise direction (as another example of the second rotational direction) moves the planetary gear 85 in the rotational direction to the separated position. As a result, the driving power (i.e., the rotational power) of the drive motor 202 which is transmitted from the gear 88 is not transmitted to the gear 89. That is, the driving power (i.e., the rotational power) of the drive motor 202 is not transmitted to the gear 59.

As in the first modification, the controller 5 in the present modification controls the drive motor 202 to be driven reversely during a period extending from the end of the conveyance and so on of the sheet P which are caused by the forward rotation of the drive motor 202, to the point in time when the recording head 21 reaches the maintenance position. In this control, in the present modification, the controller 5 controls the drive motor 202 to cause generally half rotation of the gear 88. As a result, the planetary gear 85 is moved from the power transmitting position illustrated in FIG. 12A to the separated position illustrated in FIG. 12B. It is noted that in the case where the planetary gear 85 can be moved from the power transmitting position to the separated position, the gear 88 may be rotated by less than or greater than its half rotation.

Moving the planetary gear 85 to the separated position as described above establishes a state in which the first output gear 81 is rotatable so as to be meshed with the switching gear 71. That is, as in the above-described embodiment and first modification, when having received the print instruction in the standby state, the controller 5 controls the drive motor 202 and the carriage drive motor 201 to establish the non-sealing state and then move the recording head 21 from the maintenance position to the flushing position. As a result of this movement of the recording head 21 to the flushing position, the guide piece 92 ceases pushing the input lever 74 rightward, and the switching gear 71 is moved from the second position to the first position. In this movement, as in the above-described embodiment and first modification, as illustrated in FIG. 10B, even when the tapered portions 71*b* of the teeth 71*a* of the switching gear 71 are respectively brought into contact with the tapered portions 81*b* of the teeth 81*a* of the first output gear 81, the first output gear 81 is in the state in which the first output gear 81 is rotatable together with the planetary gear 85, and accordingly the first output gear 81 and the planetary gear 85 are rotated with the leftward movement of the switching gear 71 such that each of the teeth 71*a* of the switching gear 71 enters an area between corresponding two of the teeth 81*a* of the first output gear 81. As a result, the switching gear 71 is moved to the first position at which the switching gear 71 and the first output gear 81 are meshed with each other. Also in the present second modification, immediately after the guide piece 92 ceases pushing the input lever 74 rightward (before the recording head 21 reaches the flushing position), the movement of the switching gear 71 to the first position is finished.

Also in the present modification described above, when the recording head 21 is moved by the moving mechanism 40 from the maintenance position to a position different from the maintenance position (e.g., the flushing position), the switching gear 71 is moved by the coil spring 75 from the second position toward the first position. In this movement, when the planetary gear 85 is located at the separated position, the first output gear 81 is in its rotatable state. Thus, even when the first output gear 81 is not located at the position at which the first output gear 81 is meshed with the switching gear 71, the switching gear 71 can be rotated so as to be meshed with the first output gear 81 while being moved from the second position to the first position. Accordingly, there is no need to perform the rocking operation for driving the drive motor 202 to rotate the switching gear 71 in order to mesh the switching gear 71 and the first output gear 81 with each other, thereby reducing the length of time required for meshing the switching gear 71 with the first output gear 81. As a result, it is possible to reduce the length of time required from the reception of the print instruction in the standby state in which the recording head 21 is covered with the cap 61, to the discharging of the printed sheet P.

In the above-described first and second modifications, the groove 86 guides the planetary gear 85 between the power transmitting position and the separated position. However, the planetary gear 85 may be rotatably supported by a coupled member which is pivotably coupled to the shaft member of the gear (e.g., the first output gear 81 or the gear 88) always meshed with the planetary gear 85. In this construction, the coupled member moves the planetary gear 85 between the power transmitting position and the separated position. This construction can also obtain the same effects as obtained in the above-described first and second modifications.

While the embodiment has been described above, it is to be understood that the disclosure is not limited to the details of the illustrated embodiment, but may be embodied with various changes and modifications, which may occur to those skilled in the art, without departing from the spirit and scope of the disclosure. For example, in the above-described embodiment, the controller 5 controls the drive motor 202 to move the contact portion 72*a* to the generally center between the pair of faces 73*c*1, 73*c*2 before the recording head 21 is moved from the maintenance position to the position different from the maintenance position, but this control may be omitted. Also in this case, there is a clearance (play) between the contact portion 72*a* and at least one of the pair of faces 73*c*1, 73*c*2, the switching gear 71 is rotatable in a direction directed toward the clearance when the switching gear 71 is moved from the second position to the first position. Thus, the switching gear 71 is moved from the second position to the first position while being rotated so as to be meshed with the first output gear 81. This construction can obtain the same effects as obtained in the above-described embodiment. Also, while the recording head 21 performs the flushing before printing in the above-described embodiment, the recording head 21 performs printing without flushing. In this construction, the recording head 21 may be moved from the maintenance position to a position at which the recording head 21 is opposed to the platen 22 (as a position different from the maintenance position), and before the recording head 21 is moved to this position, the controller 5 needs to control the drive motor 202 to move the contact portion 72*a* to the generally center between the pair of faces 73*c*1, 73*c*2. This configuration can obtain the same effects as obtained in the above-described embodiment. Also, the lift-up mechanism as the cap moving mechanism may have a construction different from the construction in which the lift-up mechanism moves the cap 61 upward and downward by the driving power transmitted from the drive motor 202. For example, the lift-up mechanism may not include the drive motor 202 but include, instead of the drive motor 202, (a) a support member for supporting the cap 61, (b) a contact portion capable of contacting the carriage 23 provided on this support member, and (c) an inclined surface extending in the right and left direction 9 to guide the support member. This construction can move the cap 61 upward and downward in conjunction with the movement of the carriage 23, and the drive motor 202 is not required, making it possible to reduce the number of components.

The printing unit 11 may include: a sub-sheet-supply tray different from the main sheet-supply tray 15; and a sheet-supply mechanism for supplying a sheet from the sub-sheet-supply tray. In this construction, the second driven mechanism may be a sheet-supply mechanism for supplying a sheet from the sub-sheet-supply tray. Also, the printing unit 11 may include a wiping mechanism for wiping the ejection surface 21*a*. In this construction, the first driven mechanism may be the wiping mechanism, and the second driven mechanism may be the conveying mechanism or the cap 61 and the lift-up mechanism 65 in the above-described embodiment. The first driven mechanism in the above-described embodiment is the conveying mechanism for conveying the sheet P but may be constituted only by the supply device 30. As described above, each of the first and second driven mechanisms may be any mechanism as long as the mechanism is a drive mechanism employed for the printing unit 11 as the liquid ejection apparatus.

In view of the above-described embodiment and modifications, the printing unit 11 can be considered to include a power transmission switching device configured to position the switching gear 71 selectively to one of the first position and the second position to transmit the driving power generated by the drive motor 202, selectively to one or ones of a plurality of components. In the above-described embodiment, the power transmission switching device positions the switching gear 71 selectively to one of the first position and the second position and switches between the forward rotation and reverse rotation of the switching gear 71 to selectively perform one of the various operations including the conveyance of the sheet P and the movement of the cap 61. However, the present invention is not limited to this configuration. For example, the power transmission switching device may be applied to a sheet conveying device configured to use a single motor to supply a sheet selectively from one of a plurality of sheet-supply trays. In this case, the power transmission switching device transmits driving power generated by the motor, selectively to one of a plurality of sheet-supply rollers provided for the respective sheet-supply trays, for example.

In the above-described printing unit 11, the movement of the carriage 23 causes the switching-gear moving mechanism 78 to move the switching gear 71. However, another driving source may be used to cause the switching-gear moving mechanism 78 to move the switching gear 71. For example, a motor specific to the switching-gear moving mechanism 78 may be provided to operate the switching-gear moving mechanism 78.

In the above-described printing unit 11, the shaft member 72 and the shaft member 55*b*1 may be the same shaft member. Also, the drive motor 202 may be provided with a rotary encoder 210 (see FIG. 6) for detecting an amount (distance) of conveyance of the sheet. Specifically, this rotary encoder 210 is capable of detecting a rotation amount of the shaft member (i.e., the shaft members 72, 55*b*1). Where the printing unit 11 is thus configured, the controller 5 may execute the following processing. For example, during a period extending from the point in time when the second output gear 82 is rotated in one direction to establish the non-sealing state of the ejection surface 21*a* to the point in time when the recording head 21 reaches the flushing position, the controller 5 changes the rotation of the drive motor 202 from the reverse rotation for establishing the non-sealing state of the cap 61, to the forward rotation to rotate the shaft member in a reverse direction that is reverse to the one direction, and when the rotary encoder 210 has detected a particular rotation amount of the shaft member, the controller 5 controls the drive motor 202 to stop the rotation of the shaft member.

In the above-described embodiment, the spaces are formed between the shaft member 72 and the input gear 73, each as the play allowing the switching gear 71 to be rotated so as to be meshed with the first output gear 81 when the switching gear 71 is moved from the second position to the first position. However, play may be formed at any position between the input gear 73 and the drive motor 202. In other words, play may be formed between any components of a power transmitter including the input gear 73 and a motor gear and configured to transmit the power from the drive motor 202 to the switching gear 71. For example, the printing unit 11 may be configured such that the transmission mechanism 70 further includes a drive gear fitted on a drive shaft of the drive motor 202, and play is formed between the drive gear and the input gear 73 so as to allow the input gear 73 to rotate with respect to the drive gear in the rotational direction of the input gear 73. Furthermore, the printing unit 11 may be configured such that the transmission mechanism 70 further includes an intermediate gear between the drive gear and the switching gear 71. In this construction, the printing unit 11 is, for example, constructed as follows: the drive gear is provided with a protrusion which protrudes toward the input gear 73; a recess is formed in one of opposite faces of the intermediate gear which is nearer to the drive gear; the protrusion provided on the drive gear is fitted in the recess formed in the intermediate gear; and the recess is larger than the protrusion in the circumferential direction (the radial direction) of the gears. This construction can also obtain the same effects as obtained in the above-described embodiment.

While the present invention is applied to the ink jet printer configured to perform printing by ejecting ink from the nozzles, the present invention is not limited to this configuration. For example, the present invention may be applied to a liquid ejection apparatus different from the ink-jet printer which ejects liquid different from ink from the nozzles.

What is claimed is:

1. A power transmission switching device, comprising:

a drive source;

a first driven mechanism;

a second driven mechanism; and a transmission mechanism configured to transmit driving power transmitted from the drive source, selectively to one of the first driven mechanism and the second driven mechanism, the transmission mechanism comprising:

an input gear rotatable by the driving power transmitted from the drive source;

a first gear configured to transmit the driving power to the first driven mechanism;

a second gear configured to transmit the driving power to the second driven mechanism;

a switching gear movable, in a direction parallel with an axial direction of the input gear, and a position of which is switched between a first position at which the switching gear is meshed with the first gear and a second position at which the switching gear is meshed with the second gear, the switching gear being meshed with the input gear when the switching gear is located at any of the first position and the second position; and a power transmitter comprising the input gear and a shaft member rotatable by the driving power transmitted from the drive source, the shaft member supporting the input gear so as to rotate with the input gear, the power transmitter being configured to transmit the driving power from the drive source to the switching gear, play being formed between the shaft member and the input gear, the play allowing the input gear and the shaft member to rotate with respect to each other in a rotational direction thereof, and a controller configured to control the drive source in a first rotational operation in which, before the position of the switching gear is switched, a first driving power causing the shaft member to rotate in a first rotational direction by a first rotational amount is transmitted from the drive source, the first rotational amount being equal to or greater than rotational amount corresponding to a length of the play in the rotational direction, wherein the controller is configured to control the drive source in a second rotational operation in which, after the first driving power is transmitted to the shaft member and before the position of the switching gear is switched, a second driving power causing the shaft member to rotate in a second rotational direction by a second rotational amount is transmitted from the drive source, the second rotational amount being less than the rotational amount corresponding to the length of the play in the rotational direction, the second rotational direction being opposite the first rotational direction.

2. The power transmission switching device according to claim 1, wherein the drive source comprises a drive shaft, wherein the power transmitter further comprises a drive gear fitted on the drive shaft of the drive source, and wherein play is formed between the drive gear and the input gear, and the play allows the input gear to rotate with respect to the drive gear in the rotational direction of the input gear.

3. A liquid ejection apparatus, comprising:

a liquid ejection head comprising an ejection surface in which a plurality of nozzles are formed;

a conveyor configured to convey a recording medium in a conveying direction such that the recording medium is to face the ejection surface;

a cap configured to seal off the nozzles formed in the ejection surface;

a cap-moving mechanism configured to switch a state of the cap between a sealing state in which the cap seals off the nozzles and a non-sealing state in which the cap does not seal off the nozzles; and the power transmission switching device according to claim 1, wherein the controller is configured to control the drive source in the first rotational operation in which the first driving power causing the cap-moving mechanism to switch the state of the cap from the sealing state to the non-sealing state in the first rotational direction by the first rotational amount is transmitted from the drive source, wherein the controller is configured to control the drive source in the second rotational operation in which the second driving power causing the cap-moving mechanism to switch the state of the cap from the non-sealing state to the sealing state in the second rotational direction by the second rotational amount is transmitted from the drive source.

4. The power transmission switching device according to claim 1, wherein the controller is configured to control the drive source in the second rotational operation in which the second driving power causing the shaft member to rotate in the second rotational direction by half of the rotational amount corresponding to the length of the play in the rotational direction as the second rotational amount.

5. The power transmission switching device according to claim 1, wherein one of the input gear and the shaft member comprises a pair of faces opposed to and spaced apart from each other in the rotational direction, wherein the another of the input gear and the shaft member comprises a contact portion disposed between the pair of faces, and the contact portion is contactable with at least one of the pair of faces to transmit rotational power of the shaft member to the input gear, and wherein the controller is configured to control the drive source in the second rotational operation in which the second driving power causing the shaft member to rotate in the second rotational direction by a third rotational amount as the second rotational amount, the third rotational amount being half of a rotational amount corresponding to a length obtained by subtracting a length of the contact portion in the rotational direction from a length between a first face of the pair of faces and a second face of the pair of faces in the rotational direction.

6. The power transmission switching device according to claim 5, wherein the third rotational amount is determined such that the contact portion and each of the pair of faces are not brought into contact with each other when the input gear meshing with the switching gear is rotated, with respect to the shaft member, by a rotational amount corresponding to half pitch of teeth of the switching gear.

7. The power transmission switching device according to claim 6, wherein the third rotational amount is determined such that the contact portion is brought into contact with any one of the pair of faces when the input gear meshing with the switching gear is rotated, with respect to the shaft member, by a rotational amount corresponding to one pitch of the teeth of the switching gear.

8. The liquid ejection apparatus according to claim 3, wherein the controller is configured to control the drive source in the second rotational operation in which the second driving power causing the shaft member to rotate in the second rotational direction by half of the rotational amount corresponding to the length of the play in the rotational direction as the second rotational amount.

9. The liquid ejection apparatus according to claim 3, wherein one of the input gear and the shaft member comprises a pair of faces opposed to and spaced apart from each other in the rotational direction, wherein the another of the input gear and the shaft member comprises a contact portion disposed between the pair of faces, and the contact portion is contactable with at least one of the pair of faces to transmit rotational power of the shaft member to the input gear, and wherein the controller is configured to control the drive source in the second rotational operation in which the second driving power causing the shaft member to rotate in the second rotational direction by a third rotational amount as the second rotational amount, the third rotational amount being half of a rotational amount corresponding to a length obtained by subtracting a length of the contact portion in the rotational direction from a length between a first face of the pair of faces and a second face of the pair of faces in the rotational direction.

10. The liquid ejection apparatus according to claim 9, wherein the third rotational amount is determined such that the contact portion and each of the pair of faces are not brought into contact with each other when the input gear meshing with the switching gear is rotated, with respect to the shaft member, by a rotational amount corresponding to half pitch of teeth of the switching gear.

11. The liquid ejection apparatus according to claim 10, wherein the third rotational amount is determined such that the contact portion is brought into contact with any one of the pair of faces when the input gear meshing with the switching gear is rotated, with respect to the shaft member, by a rotational amount corresponding to one pitch of the teeth of the switching gear.

* * * * *